US006910757B2

(12) United States Patent
Kanamitsu et al.

(10) Patent No.: US 6,910,757 B2
(45) Date of Patent: Jun. 28, 2005

(54) WASTE LIQUID TREATING DEVICE AND LIQUID EJECTING APPARATUS INCORPORATING THE SAME

(75) Inventors: Masatomo Kanamitsu, Nagano (JP); Naruhiko Katagiri, Nagano (JP); Hajime Wada, Nagano (JP); Keisuke Haba, Nagano (JP); Midori Araya, Nagano (JP); Masahiro Isono, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 10/458,749

(22) Filed: Jun. 11, 2003

(65) Prior Publication Data

US 2004/0051755 A1 Mar. 18, 2004

(30) Foreign Application Priority Data

Jun. 11, 2002 (JP) ..... P2002-170282
Sep. 19, 2002 (JP) ..... 2002-272918
Oct. 22, 2002 (JP) ..... P2002-306615

(51) Int. Cl.[7] ..... B41J 2/165
(52) U.S. Cl. ..... 347/31; 347/35; 347/36
(58) Field of Search ..... 347/29, 30, 31, 347/33, 35, 36; 521/52; 428/310.5

(56) References Cited

U.S. PATENT DOCUMENTS

2002/0033860 A1 3/2002 Kubota et al.
2004/0125154 A1 * 7/2004 Cheney et al.

FOREIGN PATENT DOCUMENTS

| | | | |
|---|---|---|---|
| EP | 0 995 603 | A2 | 4/2000 |
| EP | 1 147 901 | A2 | 10/2001 |
| JP | 10-58705 | A | 3/1998 |
| JP | 10-211706 | A | 8/1998 |
| JP | 2002-103706 | A | 4/2000 |
| JP | 2000-141704 | A | 5/2000 |
| JP | 2000-158678 | A | 6/2000 |
| JP | 2001-301201 | A | 10/2001 |
| JP | 2002-86757 | A | 3/2002 |
| JP | 2002-86821 | A | 3/2002 |

OTHER PUBLICATIONS

Japanese Office Action dated Jan. 25, 2005.

* cited by examiner

*Primary Examiner*—Shih-wen Hsieh
(74) *Attorney, Agent, or Firm*—Sughrue Mion, PLLC

(57) ABSTRACT

A liquid ejecting head is operable to move in a first direction. A platen is opposed to the liquid ejecting head to support an object to which a liquid droplet is ejected from the liquid ejecting head and to define a gap between the liquid ejecting head and the object. The platen is formed with a groove hole to which a liquid droplet deviated from an edge of the object is disposed, and through holes formed in a bottom portion of the groove hole and arranged in the first direction. A tray member is arranged below the platen to receive liquid dropped through the through holes. A first liquid absorber is provided in the groove hole. A second liquid absorber is provided in the tray member. At least one liquid leading member extends through at least one of the through holes to lead liquid absorbed by the first liquid absorber to the second liquid absorber.

28 Claims, 20 Drawing Sheets

WASTE LIQUID TREATING DEVICE AND LIQUID EJECTING APPARATUS INCORPORATING THE SAME

BACKGROUND OF THE INVENTION

The present invention relates to a liquid ejecting apparatus such as an ink jet recording apparatus which can execute so-called marginless printing by disposing ink away from the end of a recording medium. Other than recording apparatuses such as printers, copiers, facsimile machines, the liquid ejecting apparatus includes an apparatus for ejecting liquid, in place of ink, from a liquid ejecting head onto an object on which the ejected liquid is landed.

Examples of the liquid ejecting head include a colorant ejecting head to be used for manufacturing a color filter such as a liquid crystal display, an electrode material (conductive paste) ejecting head to be used in the formation of an electrode such as an organic EL display or a surface emitting display (FED), a biological organic matter ejecting head to be used for manufacturing a biochip and a sample ejecting head to be a precision pipette in addition to the recording head.

An ink jet recording apparatus (hereinafter referred to as a "printers") has an ink jet recording head (hereinafter referred to as a "recording head") for discharging an ink, and a platen provided opposite to the recording head and supporting a sheet from below to define a distance between the recording head and a printing surface. Furthermore, some printers can execute so-called marginless printing to print a sheet without a margin (for example, see Japanese Patent Publication No. 2002-86821A).

In the printer capable of executing the marginless printing, a groove hole is formed on the upper surface of the platen (a platen surface). The groove hole includes a groove hole formed to be extended in a primary scanning direction over the platen surface and a groove hole provided to be localized in a portion positioned on the end of a sheet. For example, when the leading end of the sheet is positioned above the groove hole formed to be extended in the primary scanning direction, ink is also ejected to a region provided out of the leading end so that the marginless printing is carried out at the leading end. In other words, the ink is disposed into the groove hole.

In general, an ink absorber (hereinafter referred to as a "first waste liquid absorber") for absorbing ink is provided in the groove hole. If such a first waste liquid absorber is not provided, there is a possibility that the ink disposed into the groove hole might become an ink mist to deteriorate printing quality or might stick to the driving components of a printer to disturb a normal printing operation.

A plurality of through holes are provided in the bottom portion of the groove hole. The ink disposed into the groove hole is once absorbed into the first waste liquid absorber and is then dropped downward from the through hole. Accordingly, a waste liquid tray for receiving the ink thus dropped is provided under the platen. An ink absorber (hereinafter referred to as a "second waste liquid absorber") for absorbing ink is provided in the waste liquid tray in the same manner as the groove hole. Consequently, the ink stored in the waste liquid tray is reliably held so as not to leak to the outside.

The ink disposed into the groove hole is absorbed by the first waste liquid absorber. The ink thus absorbed is not entirely dropped into the waste liquid tray. More specifically, a part of the ink is dropped from the through hole toward the waste liquid tray and the other part is maintained in the lower part of the first waste liquid absorber according to the ink holding property of the first waste liquid absorber.

If the printer is greatly inclined in the handling or transportation of a user in such a state, for example, the ink held in the lower part of the first waste liquid absorber concentrates on the end of a platen and might overflow out of the groove hole in the worst case. When such a phenomenon arises, there is a possibility that the components of the printer (for example, a driving system or an electric system) might be adversely influenced, and furthermore, the ink might leak out of the printer.

In the method described above, furthermore, the ink is not dropped until the amount of the absorption of the ink in the first waste liquid absorber approaches a saturation. Accordingly, there is a possibility that the ink might be maintained in a large amount in the first waste liquid absorber for a long period of time. As a result, in the case in which an ink jet recording apparatus is used with an inclination due to transportation between users, the ink stored in the first waste liquid absorber flows out of the apparatus in some cases. In the case in which an ink which is easily solidified, for example, a pigment based ink is used, particularly, there is a possibility that the ink might be held in the first waste liquid absorber for a long period of time and the ink solidified on the surface of the first waste liquid absorber might be thus deposited to deteriorate the absorbing capability of the first waste liquid absorber.

As another configuration of the ink jet recording apparatus, therefore, a first waste liquid absorber and a second waste liquid absorber are formed integrally (for example, see Japanese Patent Publication No. 2001-301201A; page 7 and FIG. 7). Consequently, an ink absorbed in the first waste liquid absorber is only moved exactly in the direction of a gravity in the first waste liquid absorber and is then held by the second waste liquid absorber so that the movement of the ink from the first waste liquid absorber to the second waste liquid absorber can be carried out quickly. Thus, the ink can be prevented from overflowing from the first waste liquid absorber or being solidified.

However, a component having such a configuration that the first waste liquid absorber and the second waste liquid absorber are integrated has a novel configuration which has not been conventionally obtained. For this reason, there is an anxiety that the design of an ink jet recording apparatus might be changed considerably when the such a component is employed. There is an anxiety that a cost might be increased due to the change in a design and a production efficiency might be reduced.

SUMMARY OF THE INVENTION

It is therefore an object of the invention to provide a liquid ejecting apparatus, in which waste liquid disposed to a waste liquid absorber provided in a groove hole can be smoothly lead to a waste liquid tray arranged in a lower portion of the apparatus, without involving cost increasing or remarkable design change.

In order to achieve the above object, according to the invention, there is provided a liquid ejecting apparatus, comprising:

a liquid ejecting head, operable to move in a first direction;

a platen, opposed to the liquid ejecting head to support an object to which a liquid droplet is ejected from the liquid ejecting head and to define a gap between the liquid ejecting head and the object, the platen formed with a groove hole to which a liquid droplet deviated from an edge of the object is disposed, and through holes formed in a bottom portion of the groove hole and arranged in the first direction;

a tray member, arranged below the platen to receive liquid dropped through the through holes;

a first liquid absorber, provided in the groove hole;

a second liquid absorber, provided in the tray member; and at least one liquid leading member, extending through at least one of the through holes to lead liquid absorbed by the first liquid absorber to the second liquid absorber.

In such a configuration, the liquid is hardly held in the lower part of the first waste liquid absorber. Also in the case where the liquid ejecting apparatus is inclined greatly in handling or transportation, there can be eliminated a drawback that the liquid held in the first waste liquid absorber is collected into the end part of the platen and then overflows to the outside. Consequently, a safety can be enhanced in the handling or the transportation.

Preferably, the liquid leading member is a third liquid absorber having a liquid absorbance higher than a liquid absorbance of the first liquid absorber.

In such a configuration, the liquid leading member can be obtained inexpensively and easily The "high liquid absorbance" means that the capillary action is relatively remarkable so that the same amount of liquid can be spread over a wider area.

Here, it is preferable that a liquid absorbance of the second liquid absorber is higher than the liquid absorbance of the third liquid absorber.

In such a configuration, the liquid can be reliably led into the tray member.

Preferably, the through hole in which the liquid leading member is provided is placed at a position where a flushing operation of the liquid ejecting head is performed.

In the liquid ejecting apparatus, a so-called flushing (recovery) operation in which liquid is idly ejected is performed so that the nozzle orifice of the liquid ejecting head is not clogged up. The flushing operation is carried out in the vicinity of the end of the primary scanning region (the first direction) of the liquid ejecting head. In the position where the flushing operation is performed, accordingly, the liquid is disposed in a larger amount.

According to the above configuration, therefore, the function of the liquid leading member can be exhibited more effectively. Thus, the problem related to the overflow of the ink can be solved more reliably.

Here, it is preferable that the position at which the flushing operation is performed is not located at a home position of the liquid ejecting head.

In such a configuration, even in the case where an electronic component is arranged on the away position side, the liquid overflow problem can be solved by the function of the liquid leading member, and there is no anxiety that the electronic component might be adversely influenced.

Preferably, the through hole in which the liquid leading member is provided is placed at a position where a lower position of the platen which is an inclined state in connection with the first direction.

The platen is elongated in the first direction. In some cases in which the platen is provided in the liquid ejecting apparatus, it is inclined at a predetermined angle in the first direction by the influence of precision in a component or precision in an assembly. By such an inclination, the liquid disposed into the groove hole would be collected into the lower side so that the liquid overflow problem is apt to arise.

However, according to the above configuration, the function of the liquid leading member can be exhibited at the lower side where the liquid would be collected. Thus, the liquid overflow problem can be prevented reliably.

Preferably, the liquid leading member is an individual member comprised of a porous material.

In such a configuration, since the liquid leading member and the second liquid absorber are provided separately, one which has conventionally been used can be utilized exactly as the second liquid absorber. Therefore, a considerable change in a design is not required on the liquid ejecting apparatus.

Preferably, the liquid leading member is a sheet-like member having a portion to be extended through the at least one of the through holes.

In such a configuration, it is possible to easily form the liquid leading member by slightly processing the liquid absorber which has conventionally been used, and a considerable change in a design is not required. Therefore, a production efficiency can be enhanced.

Here, it is preferable that the liquid leading member has a size which is at least equal to a movable range of the liquid ejecting head in the first direction.

In such a configuration, in a case where the size of the object is set within the movable range of the liquid ejecting head, the disposed liquid can be reliably absorbed in the liquid leading member even if the liquid is deviated from all the edges of the object. As a result, the liquid can be ejected to all the edges of targets having various shapes.

It is also preferable that the liquid leading member is fitted into the groove hole, and the first liquid absorber is laminated thereon.

In such a configuration, by setting the total thickness of the first liquid absorber and the liquid leading member to be smaller than the depth of the groove hole, it is possible to prevent the object from coming in contact with the first liquid absorber when the object is supported by the platen. As a result, it is possible to prevent the object from being contaminated with the liquid absorbed in the first liquid absorber.

Preferably, a tip end of the liquid leading member which is to be brought into contact with the second liquid absorber is cut out obliquely.

In such a configuration, a capillary action can easily be generated between the liquid leading member and the second liquid absorber, so that the liquid absorbed in the liquid leading member can readily be moved to the second liquid absorber.

Preferably, a liquid absorbance of the liquid leading member is different from a liquid absorbance of the second liquid absorber.

In such a configuration, by setting the liquid absorbance of the second liquid absorber to be higher than that of the liquid leading member, the liquid absorbed in the liquid leading member can easily be moved to the second liquid absorber. As a result, even if the liquid ejecting apparatus is inclined by the transportation between users, the liquid does not leak out of the platen. Moreover, a time taken for the liquid to stay in the liquid leading member is shortened. Therefore, it is possible to prevent the liquid from being dried and solidified in the liquid leading member.

Preferably, the first liquid absorber is comprised of a material having a first density, and the liquid leading member is comprised of a material having a second density.

In such a configuration, by using a material having a relatively lower density for the first liquid absorber and a material having a relatively higher density for the liquid leading member, for example, a mist generated by liquid disposed into the groove hole can be absorbed by the material having the lower density. Thus, the generation of the mist can be decreased. Furthermore, the liquid absorbed in the material having the lower density is easily moved toward the material side having the higher density by a capillary action. Consequently, the liquid can be moved quickly to the liquid leading member, whereby the liquid can be moved to the second liquid absorber more reliably.

Preferably, the platen is operable to support a plurality of objects having different sizes, and the through holes are located so as to correspond to edges of the objects.

In such a configuration, the through holes are provided in places where the liquid is frequently disposed, that is, places where the liquid tends to be collected. Consequently, the liquid can be efficiently moved toward the second liquid absorber side.

Preferably, the liquid ejecting apparatus is an ink jet recording apparatus in which an ink droplet is ejected toward a recording medium supported by the platen.

According to the invention, there is also provided a waste liquid treating device, comprising:

a platen, opposed to a liquid ejecting head of a liquid ejecting apparatus, to support an object to which a liquid droplet is ejected from the liquid ejecting head, the platen formed with a groove hole to which a liquid droplet deviated from an edge of the object is disposed, and a through hole formed in a bottom portion of the groove hole;

a tray member, arranged below the platen to receive liquid dropped through the through hole;

a first liquid absorber, provided in the groove hole;

a second liquid absorber, provided in the tray member;

a liquid leading member, extending through the through hole to lead liquid absorbed by the first liquid absorber to the second liquid absorber; and a guide member, which regulates an attitude and a position of the liquid leading member.

In such a configuration, the liquid disposed from the liquid ejecting head into the groove hole is hardly held in the bottom portion of the first waste liquid absorber. In other words, the liquid is smoothly led from the first waste liquid absorber to the second waste liquid absorber. Even in the case where the liquid ejecting apparatus is greatly inclined in the handling or transportation, there is no anxiety that the liquid staying in the bottom portion of the first waste liquid absorber is collected into the end part of the platen and overflows to the outside. Thus, it is possible to maintain a safety in the handling or the transportation.

Furthermore, the attitude and position of the liquid leading member can be uniformly determined without a change caused by a variation in an assembly or a vibration generated by the transportation. Consequently, the first waste liquid absorber and the second waste liquid absorber can be reliably connected to each other through the liquid leading member. Thus, the liquid can always be led from the first waste liquid absorber to the second waste liquid absorber reliably.

Preferably, the guide member is a sheet member formed with a slit through which the liquid leading member extends.

In such a configuration, the regulating function of the guide member can be attained inexpensively with a simple structure.

Here, it is preferable that the sheet member is comprised of an elastic resin material, so that the handling of the guide member can be carried out very easily.

It is also preferable that a portion of the sheet member in which no slit is formed is opposed to an electronic unit of the liquid ejecting apparatus.

In the case where the electronic unit is provided in the vicinity of the platen, there is an anxiety that the performance of the electronic unit might be deteriorated when the liquid leading member which is wetted with the liquid comes in contact with the electronic unit.

However, according to the above configuration, the electronic unit can be guarded by the no-slit portion of the guide member from the liquid leading member. Thus, there is no anxiety that the performance of the electronic unit might be deteriorated.

Preferably, the waste liquid treating device further comprises a cover member, which covers an upper portion of the tray member, while retaining the guide member.

In such a configuration, the attitude and position of the liquid leading member can be held more reliably.

Preferably, the liquid leading member is integrally formed with the first liquid absorber.

As compared with the case where the liquid leading member and the first waste liquid absorber are constituted separately, the liquid leading member can be obtained at a lower cost.

According to the invention, there is also provided a waste liquid treating device, comprising:

a platen, opposed to a liquid ejecting head of a liquid ejecting apparatus, to support an object to which a liquid droplet is ejected from the liquid ejecting head, the platen formed with a groove hole to which a liquid droplet deviated from an edge of the object is disposed, and a through hole formed in a bottom portion of the groove hole;

a tray member, arranged below the platen to receive liquid dropped through the through hole;

a first liquid absorber, provided in the groove hole;

a second liquid absorber, provided in the tray member; and a liquid leading member, extending through the through hole to lead liquid absorbed by the first liquid absorber to the second liquid absorber, the liquid leading member integrally formed with the first liquid absorber.

In such a configuration, the liquid disposed from the liquid ejecting head into the groove hole is hardly held in the bottom portion of the first waste liquid absorber. In other words, the liquid is smoothly led from the first waste liquid absorber to the second waste liquid absorber. Even in the case where the liquid ejecting apparatus is greatly inclined in the handling or the transportation, there is no anxiety that the liquid staying in the bottom portion of the first waste liquid absorber is collected into the end part of the platen and overflows to the outside. Thus, it is possible to maintain a safety in the handling or the transportation.

Furthermore, as compared with the case where the liquid leading member and the first waste liquid absorber are constituted separately, the liquid leading member can be obtained at a lower cost.

Preferably, the first liquid absorber and the liquid leading member are comprised of a porous soft material.

In such a configuration, the first waste liquid absorber and the liquid leading member can be obtained inexpensively and a liquid absorbance can be enhanced. Thus, the liquid ejected from the liquid ejecting head can be absorbed reliably, whereby the liquid can be reliably led from the first waste liquid absorber to the second waste liquid absorber.

Preferably, the second liquid absorber has a liquid absorbance higher than a liquid absorbance of the first liquid absorber and the liquid leading member.

In such a configuration, it is possible to increase such a degree that the second waste liquid absorber draws the liquid from the first waste liquid absorber and the liquid leading member. Thus, the liquid can be led from the first waste liquid absorber to the second waste liquid absorber more reliably.

Preferably, a first part of an inner face of the groove hole and a second part of an inner face of the through hole are made flush with each other, and the liquid leading member extends along the first part and the second part.

In such a configuration, even when the liquid ejecting apparatus is inclined, the liquid collected in the end part of the groove hole smoothly flows to the tray member. Thus, a safety can be reliably maintained in the handling or the transportation.

Here, it is preferable that: at least one more through hole is arranged with the through hole in a direction along which the liquid ejecting head is operable to move; and the liquid leading member is provided in each of the through holes.

In such a configuration, even in the case where the liquid ejecting apparatus is placed and used in a horizontal state, the liquid disposed into the groove hole can be led to the tray member more smoothly.

Preferably, the liquid leading member is deformable connected to the first liquid absorber.

According to the invention, there is also provided a liquid ejecting apparatus, comprising the above waste liquid treating device, wherein the platen is arranged so as to define a gap between the liquid ejecting head and the object.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A first embodiment of the invention will be described below with reference to FIGS. 1 through 6.

Figure 1:
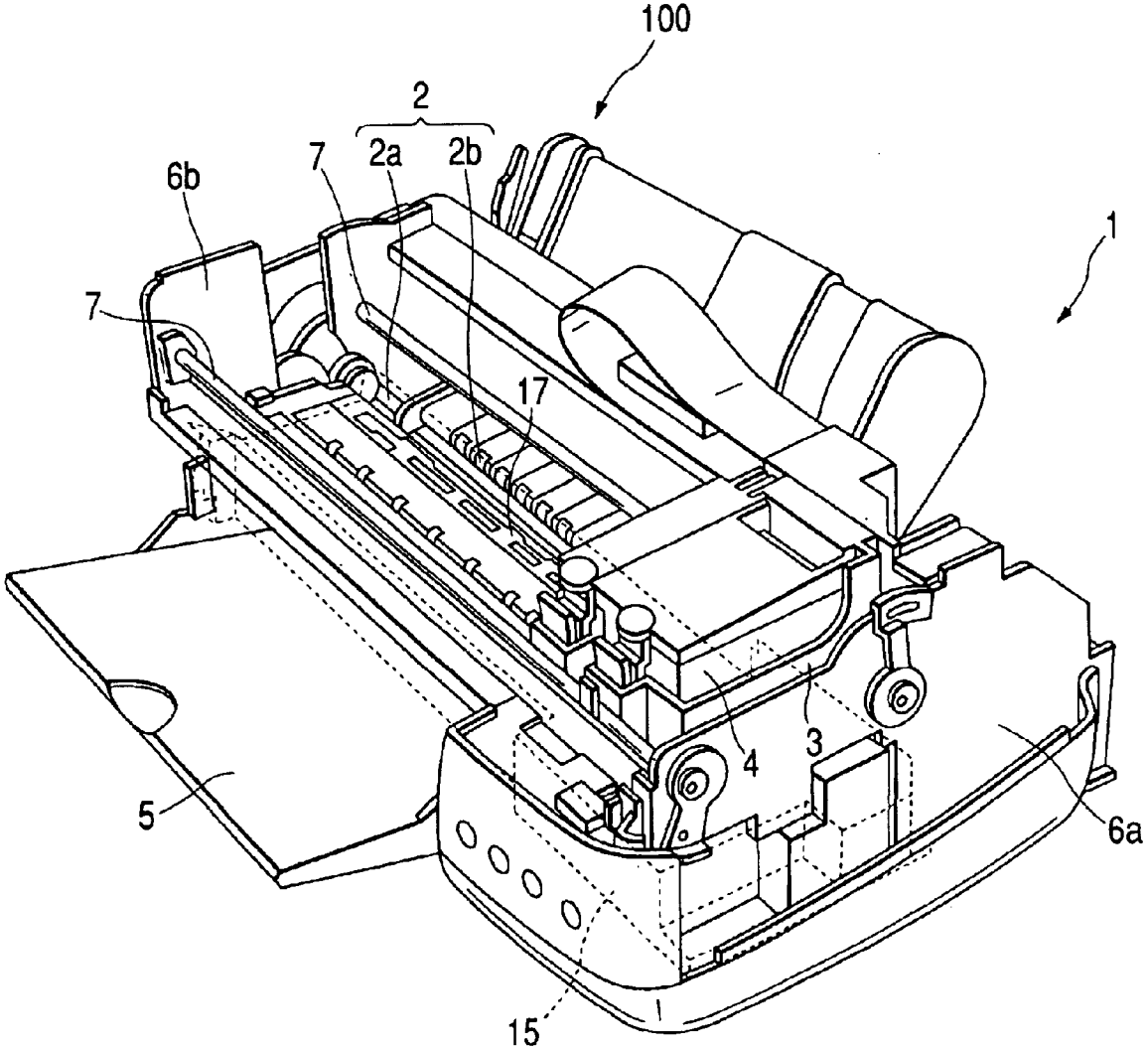
FIG. 1 is a perspective view showing the appearance of an ink jet printer according to a first embodiment of the invention.

In FIG. 1, an ink jet printer 100 (hereinafter referred to as "printer") as a liquid ejecting apparatus comprises a feeder 1 to feed an uppermost one of sheets stacked thereon toward an ink jet recording head 8 (which will be hereinafter referred to as a "recording head": see FIG. 2) provided under a carriage 3, at which recording is performed, and the sheet is ejected to a sheet discharge stacker 5 after the recording is carried out.

The carriage 3 mounts an ink cartridge 4 which supplies ink to the recording head 8. Moreover, the carriage 3 inserts a carriage guide shaft 7 provided between side frames 6*a* and 6*b* constituting the base member of the printer 100 and is guided in a primary scanning direction by the carriage guide shaft 7. The carriage 3 is reciprocated in the primary scanning direction by a driving member which is not shown.

In FIG. 1, a lower right side is defined as a "home position side" and an upper left side is defined as an "away position side". When the carriage 3 is placed at the home position side, the recording head 8 may be subjected to a maintenance operation such as capping or cleaning. When the carriage 3 is placed as the away position side, the recording head 8 may be subjected to a so-called flushing operation for performing the idle injection of ink so that ink in the nozzle orifice of a nozzle array 9 is not clogged up.

Next, the structure of the recording section of the printer 100 will be described with reference to FIG. 2. In FIG. 2, a delivery roller 2 is constituted by a delivery driving roller 2*a* to be rotated and a delivery driven roller 2*b* to be driven via a pressure contact with the delivery driving roller 2*a*, and a sheet S fed from the upstream side (the right side in FIG. 2) by the feeder 1 is nipped between the delivery driving roller 2*a* and the delivery driven roller 2*b* and is delivered to a portion provided under the recording head 8.

The nozzle array 9 for ejecting ink is provided on the recording head 8. The sheet S delivered to the lower part of the recording head 8 is subjected to the recording operation performed by ejecting ink from the nozzle array 9. At this time, the sheet S is supported from below by a platen 10 arranged opposite to the recording head 8 so that a distance from the nozzle array 9 to the sheet S (sheet gap) is defined.

More specifically, ribs 11*a* and 11*b* are formed in the upper part of the platen 10, and the sheet S is supported by the ribs 11*a* and 11*b* from below. Groove holes 12*a* and 12*b* extended in a primary scanning direction are formed in the upstream and downstream sides of the rib 11*b*, respectively. The ink deviated from the leading and trailing ends of the sheet S is disposed into the groove holes 12*a* and 12*b* so that marginless printing is executed on the leading end side and trailing end side of the sheet S. More specifically, when the leading end of the sheet S is positioned above the groove hole 12*b*, a part 9*b* of the nozzle array 9 is driven to eject ink into a portion deviated from the leading end of the sheet S, thereby executing the marginless printing at the leading end. At this time, the ink deviated from the leading end of the sheet S is disposed into the groove hole 12*b*. When the trailing end of the sheet S is positioned above the groove hole 12*a*, similarly, the part 9*a* of the nozzle array 9 is driven to eject ink into the portion deviated from the trailing end of the sheet S, thereby executing the marginless printing at the trailing end.

Figure 2:
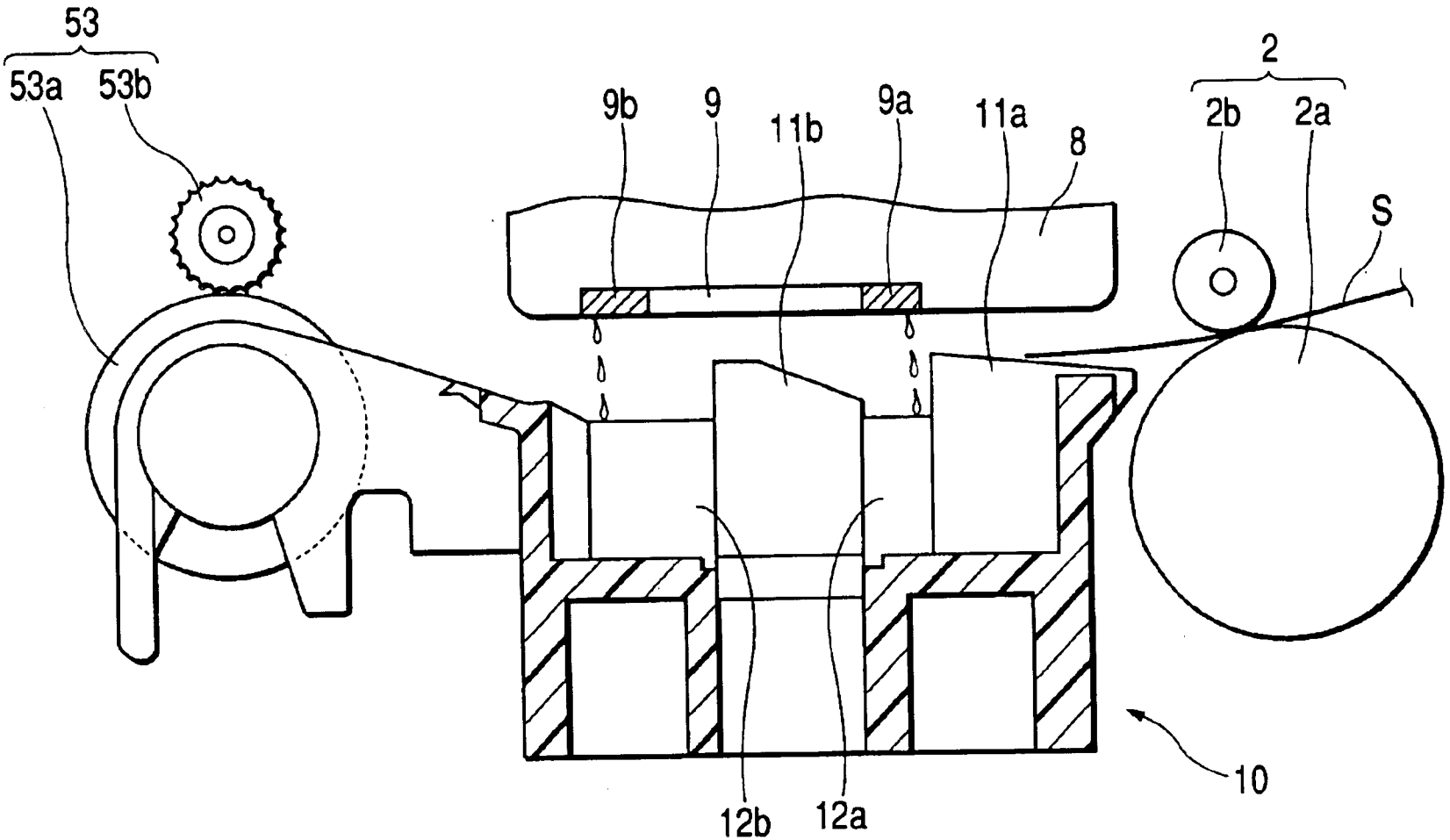
FIG. 2 is a sectional side view showing a recording section of the ink jet printer of FIG. 1.

The groove holes 12*a* and 12*b* are provided with a first waste liquid absorber 17 (see FIGS. 1 and 6) which is not shown for simplicity of FIG. 2. The structure of the platen 10 including the first waste liquid absorber 17 will be described later in more detail.

Next, a sheet discharge roller 53 to be rotated is provided on the downstream side of the platen 10. The sheet discharge roller 53 is constituted by a sheet discharge driving roller 53*a*to be rotated and a sheet discharge driven roller 53*b* to be driven via a contact with the sheet discharge driving roller 53*a*. The sheet S recorded by the recording head 8 is nipped between the sheet discharge driving roller 53*a* and the sheet discharge driven roller 53*b* and is delivered to the lower part of the discharged sheet stacker 5.

The structure of the platen 10 will be described below with reference to FIGS. 3 to 6.

Figure 3:
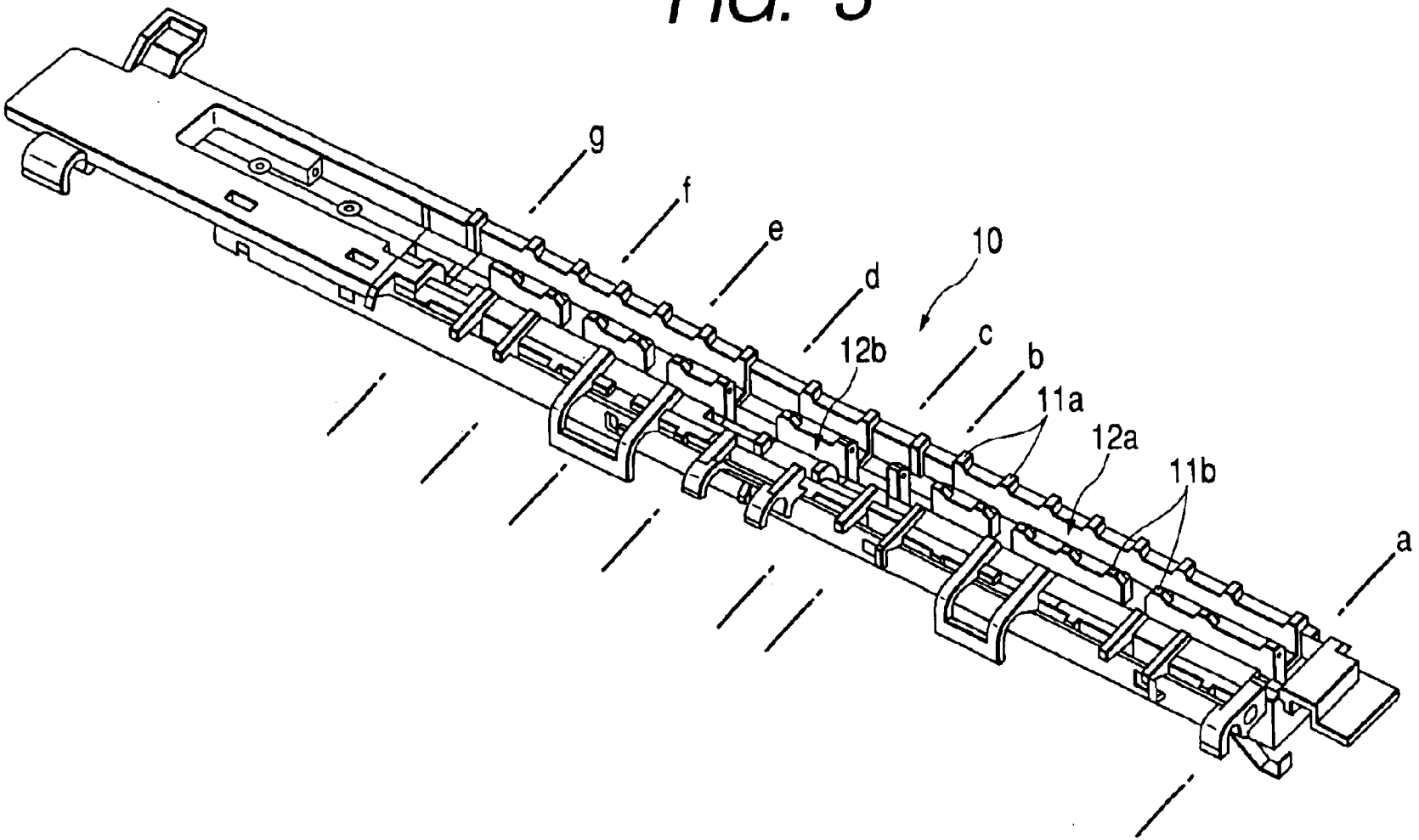
FIG. 3 is a perspective view showing the appearance of a platen in the ink jet printer of FIG. 1.
Figure 4:
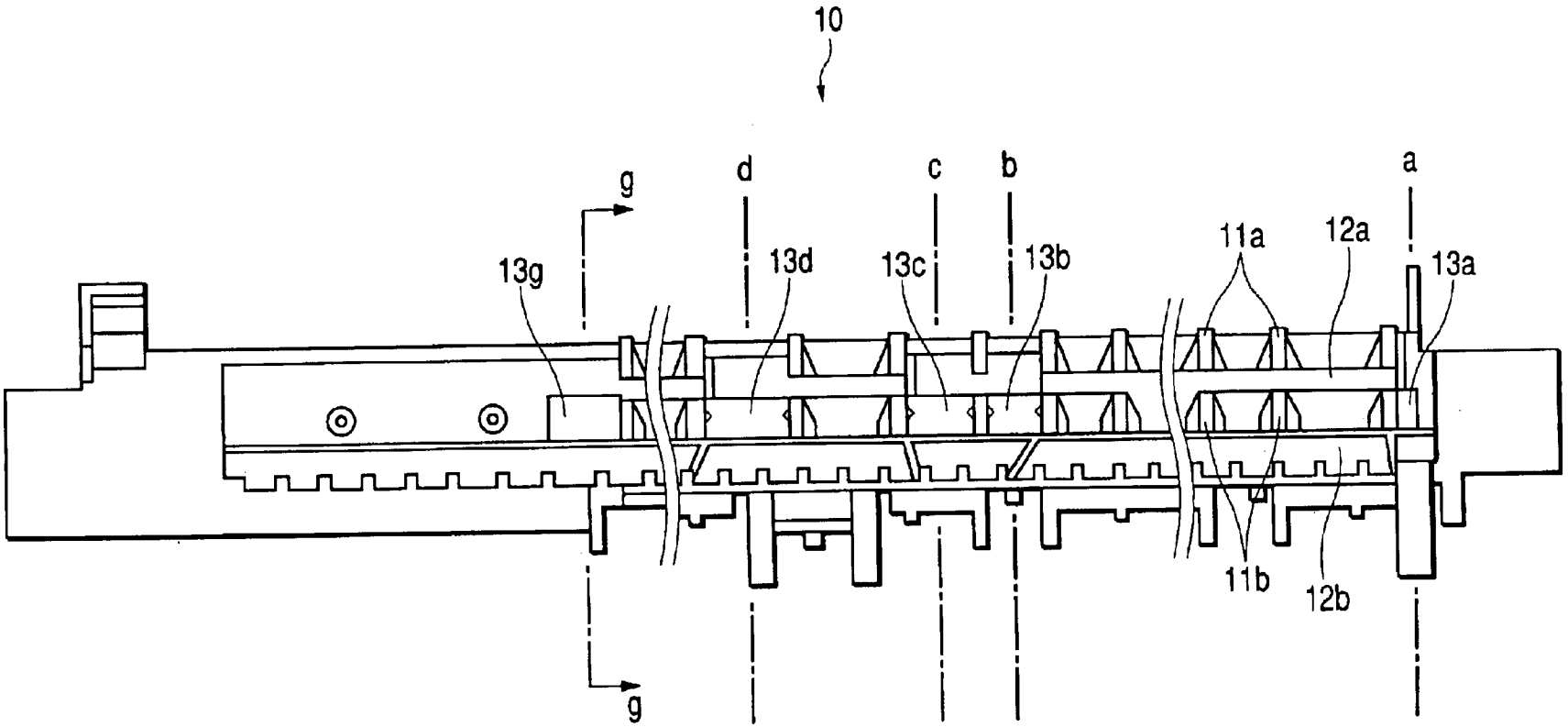
FIG. 4 is a plan view showing the platen.

As shown in FIGS. 3 and 4, the platen 10 has an elongated shape in the primary scanning direction (the direction of a sheet width) and a plurality of ribs 11*a* and 11*b* formed on the upper surface of the platen 10 at a predetermined interval in the primary scanning direction. The groove holes 12*a* and 12*b* are formed on the upstream and downstream sides of the rib 11*b* so as to be extended in the primary scanning direction of the platen 10.

The groove holes 12*a* and 12*b* are used for the marginless printing of the leading and trailing ends of the sheet as described above, and groove holes for carrying out the marginless printing at the left and right ends of the sheet are formed in positions indicated as the designations of "a" to "g" in FIG. 3 so as to be localized in positions corresponding to the width of the sheet. More specifically, the groove is formed between two adjacent ribs 11*b* in the positions indicated as the designations of "a" to "g".

The groove hole to be formed in the position "a" is placed on the most home position side, and the ends on the home position side in sheets having all sizes pass through the groove hole formed in the position "a". The groove holes to be formed in the positions "b" to "g" are placed on the away position side of the sheet, and the positions "b" to "g" are formed to correspond to an end on the away position side of sheets having various sizes. In the marginless printing to be carried out the left and right ends of the sheet, the ink is disposed into the groove hole formed in the position "a" and any of the groove holes formed in the positions "b" to "g". Consequently, the marginless printing is executed at the left and right ends of the sheet.

In FIGS. 3 and 4, the first waste liquid absorber 17 are not shown for simplicity of the drawings. All the groove holes formed in the plate 10 are provided with the first waste liquid absorber 17 to fill up them.

Through holes indicated as the designations of 13*a*, 13*b*, 13*c*, 13*d* and 13*g* (which will be hereinafter referred to as through holes 13) in FIG. 4 are formed in the bottom portions of a part of the groove holes provided in the positions "a" to "g". The through holes 13 are formed in the bottom portions of the groove holes formed in the positions indicated as "a", "b", "c", "d" and "g". Consequently, the ink disposed into the platen 10 is dropped downward from the through holes 13.

Figure 5:
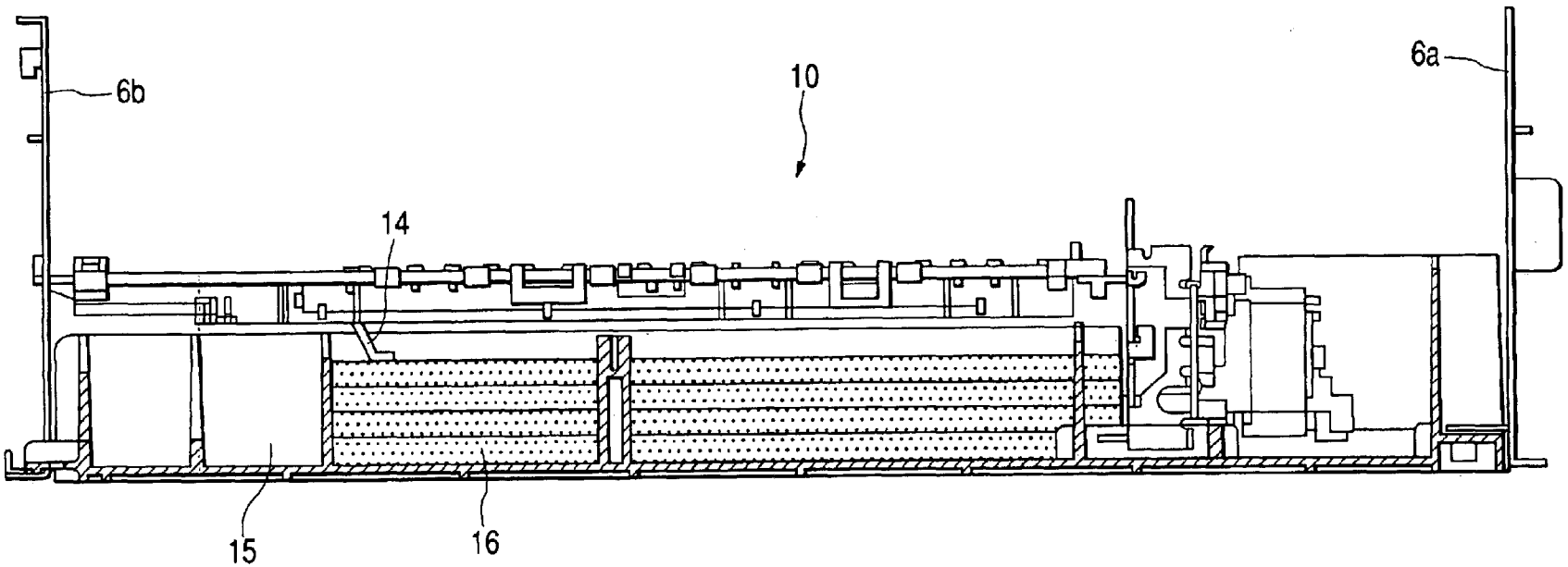
FIG. 5 is a transverse section view showing a main part of the ink jet printer of FIG. 1.

As shown in FIG. 5, the ink dropped downward from the through holes 13 is stored in the waste liquid tray 15 provided in the lower part of the platen 10 (the position of arrangement in the printer 100 is shown in FIG. 1). The waste liquid tray 15 is almost box-shaped and includes a second waste liquid absorber 16 for absorbing ink to fill up the waste liquid tray 15. Accordingly, the ink dropped downward from the through hole 13 is stored in the waste liquid tray 15 and is reliably held therein by the second waste liquid absorber 16 without the ink easily overflowing to the outside even if the printer 100 is inclined.

Figure 6:
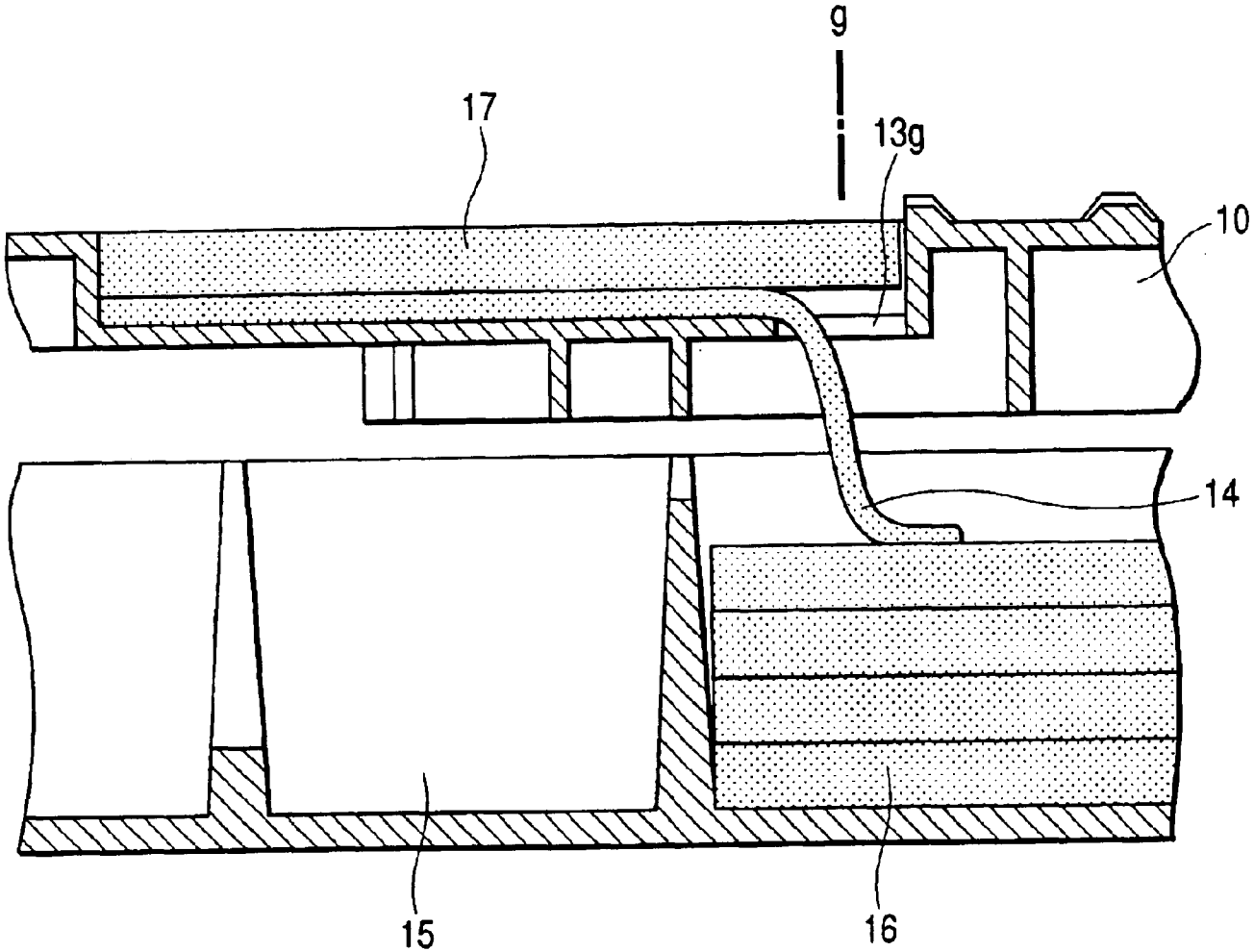
FIG. 6 is a longitudinal section view showing a main part of the platen and a waste liquid tray in the ink jet printer of FIG. 1.

As shown in FIG. 6, the first waste liquid absorber 17 is provided in the groove hole 12*a*, 12*b* formed on the platen 10. The first waste liquid absorber 17 may be formed by any material having a high ink absorbance and a high ink-resistance. For example, a synthetic fiber such as polyethylene terephthalate, acryl or rayon, a felt material formed of pulp or a porous material such as a sponge can be used. This is also common to the second waste liquid absorber 16 and the third waste liquid absorber 14 which will be described below. In the embodiment, a sponge (for example, a trade name of "Ever Light" manufactured by BRIDGESTONE CORPORATION) is used for the first waste liquid absorber 17. The ink disposed into the platen 10 is first absorbed by such a first waste liquid absorber 17.

The third waste liquid absorber 14 is provided under the waste liquid absorber 17. The third waste liquid absorber 14 is provided in only the through hole formed in the position "g" as shown in FIG. 6, that is, a through hole formed on the most away position side in the platen 10 (see FIG. 3) and is provided to hang downward via the through hole 13*g*. In other words, the third waste liquid absorber 14 is provided to connect the bottom portion of the first waste liquid absorber 17 to the top of the second waste liquid absorber 16. In the embodiment, "Belleater" (a trade name of Kanebo, LTD.) to be a porous member is used for the third waste liquid absorber 14. In the embodiment, moreover, a non-woven fabric (manufactured by OJI QUINOCROSS CO., LTD., for example) is used for the second waste liquid absorber 16 provided in the waste liquid tray 15.

The ink absorbance of each of the first waste liquid absorber 17, the second waste liquid absorber 16 and the third waste liquid absorber 14 is relatively set to be increased in order of the first waste liquid absorber 17, the third waste liquid absorber 14 and the second waste liquid absorber 16.

Description will be given to the functions and advantages of the first to third waste liquid absorbers constituted as described above. The ink disposed into the groove hole formed in the platen 10 is first absorbed in the first waste liquid absorber 17. The whole ink thus absorbed is not always dropped quickly from the through hole 13 into the waste liquid tray 15. More specifically, a part of the ink is dropped from the through hole 13 toward the waste liquid tray 15 and is then absorbed in the second waste liquid absorber 16, while the other part is held in the lower part of the first waste liquid absorber 17 because of the ink holding property of the first waste liquid absorber 17.

When the printer 100 is greatly inclined in such a state at time of the handling or transportation of a user, for example, the ink held in the lower part of the first waste liquid absorber 17 would be collected into the end part of the platen 10 (the groove hole on the most away position side shown in FIG. 6, for example) and might overflow out of the platen 10 in the worst case. When such a phenomenon arises, there is also an anxiety that the components of the printer 100 (for example, a driving system or an electric system) might be adversely influenced, and furthermore, the ink might leak out of the printer 100.

Therefore, the through hole 13*g* formed in the groove hole on the most away position side is provided with the third waste liquid absorber 14 as shown in FIG. 6. The third waste liquid absorber 14 has a higher ink absorbance than the first waste liquid absorber 17. Accordingly, the third waste liquid absorber 14 serves as a waste liquid leading member to lead the ink from the lower part of the first waste liquid absorber 17 to the second waste liquid absorber 16. The second waste liquid absorber 16 has a higher ink absorbance than the third waste liquid absorber 14. Therefore, the ink is smoothly transferred from the third waste liquid absorber 14 to the second waste liquid absorber 16.

As described above, accordingly, the ink is hard to be held in the first waste liquid absorber 17. Consequently, it is possible to eliminate the drawback that the ink is collected into the end part of the platen 10 and overflows to the outside when the printer 100 is inclined. Thus, it is possible to enhance safety in handling or transportation.

In the printer 100 according to the embodiment, particularly, since the position on the away position side where the third waste liquid absorber 14 is provided acts as the flushing position of the recording head 8, the ink is disposed into that place most remarkably in the platen 10 which is elongated in the primary scanning direction. Consequently, the advantages of the waste liquid leading member can be enhanced still more. At the same time, the third waste liquid absorber 14 is not provided in all of the through holes 13 (13*a*, 13*b*, 13*c* and 13*g*) localized in the primary scanning direction but in only the most effective place in the embodiment. Consequently, an increase in a cost can be prevented. However, it is apparent that the third waste liquid absorber 14 may be provided in all the through holes 13 to lead the ink to the waste liquid tank 15 reliably.

In addition, in some cases in which the platen 10 is provided in the printer 100, either the home position side or the away position side is inclined depending on precision in a component or precision in an assembly. In these cases, the ink is intensively collected on the low position side so that it is apt to overflow as described above. In such cases, therefore, the third waste liquid absorber 14 is provided in the through hole 13 on the low position side so that it is possible to more reliably eliminate a drawback that the ink overflows as described above.

Next, an ink jet printer (hereinafter referred to as a "printer") 200 as a liquid ejecting apparatus according to a second embodiment of the invention will be described with reference to FIGS. 7 to 11.

Figure 9:
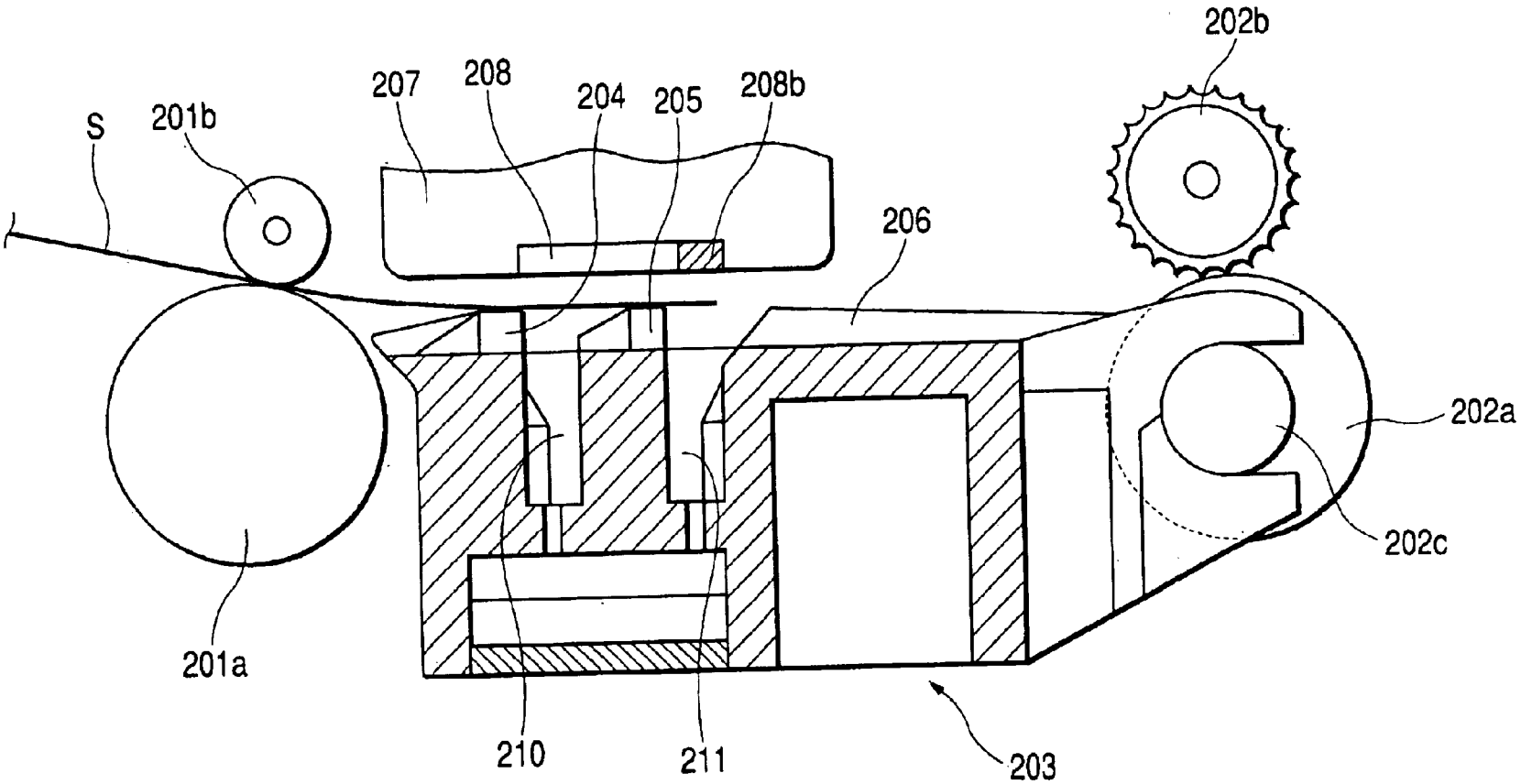
FIG. 9 is a sectional side view showing the recording section in the ink jet printer of FIG. 7, showing a condition that the marginless printing for a leading end of a sheet is performed.

The printer 200 comprises a feeder in the rear part of the apparatus (an upper left part in FIG. 7) which is not shown in detail, and feeds cut-form sheets one by one to the recording section (see FIG. 9). Moreover, the feeder includes a rolled sheet holder 228 so that a rolled sheet R can be set to be freely rotatable. In the embodiment, the medium which can be fed by the feeder will be collectively referred to as a sheet S.

The recording section provided on the downstream side of the feeder includes a delivery roller having a delivery driving roller 201*a* and a delivery driven roller 201*b* as shown in FIG. 9. The delivery driving roller 201*a* is rotated by a driving motor which is not shown and the delivery driven roller 201*b* is rotated via a pressure contact with the delivery driving roller 201*a*. The delivery roller nips the sheet S fed by the feeder from the upstream side in a delivery direction (the left side in FIG. 9) by the delivery driving roller 201*a* and the delivery driven roller 201*b*, and the delivery driving roller 201*a* is then rotated in the nip state so that the sheet S is delivered (fed precisely) to a portion provided under an ink jet recording head (hereinafter referred to as a "recording head") 207.

Figure 7:
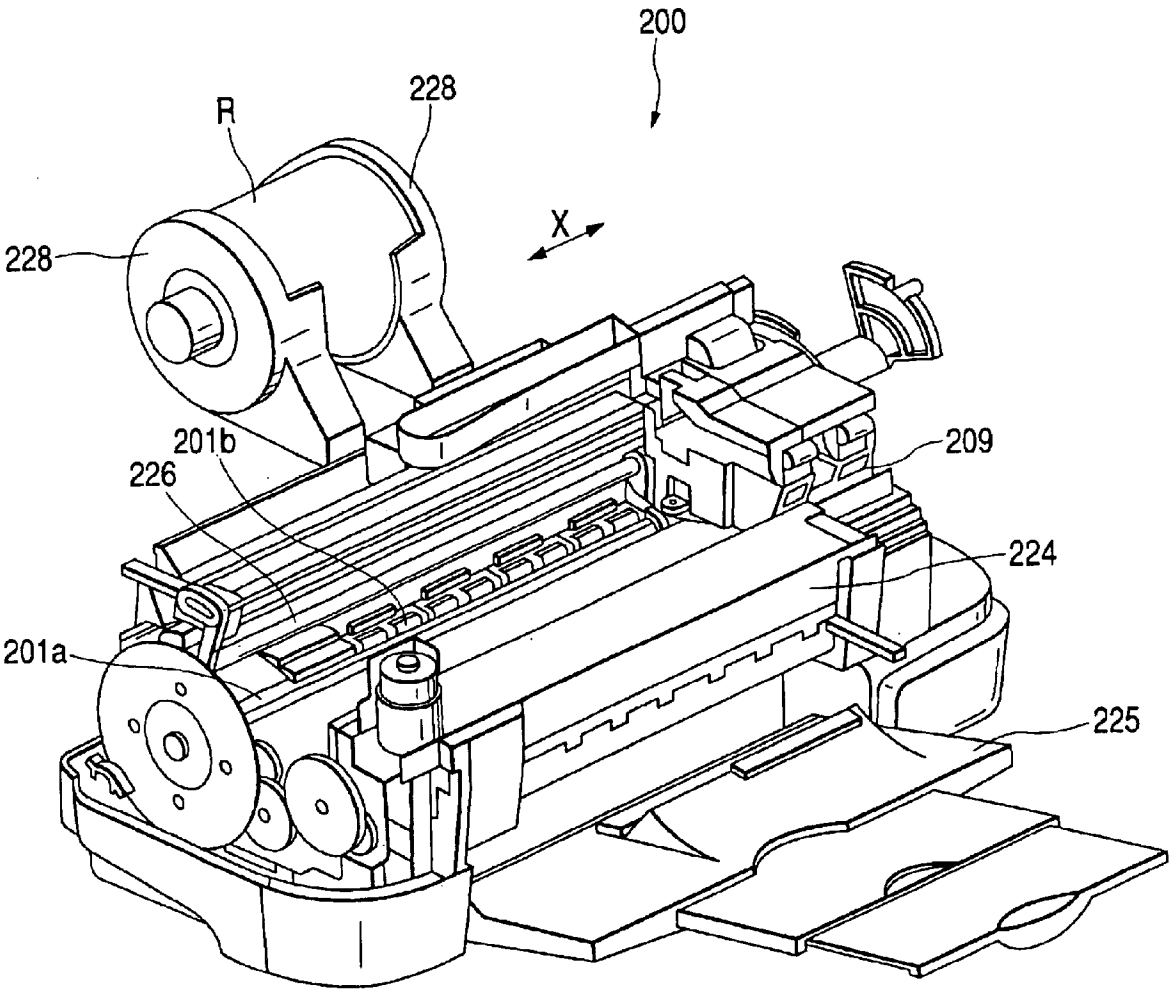
FIG. 7 is a perspective view showing the appearance of an ink jet printer according to a second embodiment of the invention.

The recording head 207 is provided in the bottom portion of a carriage 209 as shown in FIG. 7. The carriage 209 mounts an ink cartridge which supplies ink to the recording head 207. The carriage 209 is provided to insert a carriage guide shaft 226 extended in parallel with a primary scanning direction of the recording head 207 and is driven by a driving motor which is not shown, and is thus reciprocated in the primary scanning direction (a direction of an arrow X in FIG. 7).

Returning to FIG. 9, the recording head 207 has a nozzle array 208 from which ink is ejected. The sheet S delivered to the lower part of the recording head 207 is subjected to ink ejection from the recording head 207 to perform printing. At this time, the sheet S is supported from below by a platen 203 provided opposite to the recording head 207 so that a distance with the nozzle array 208 (sheet gap) is defined.

Figure 8:
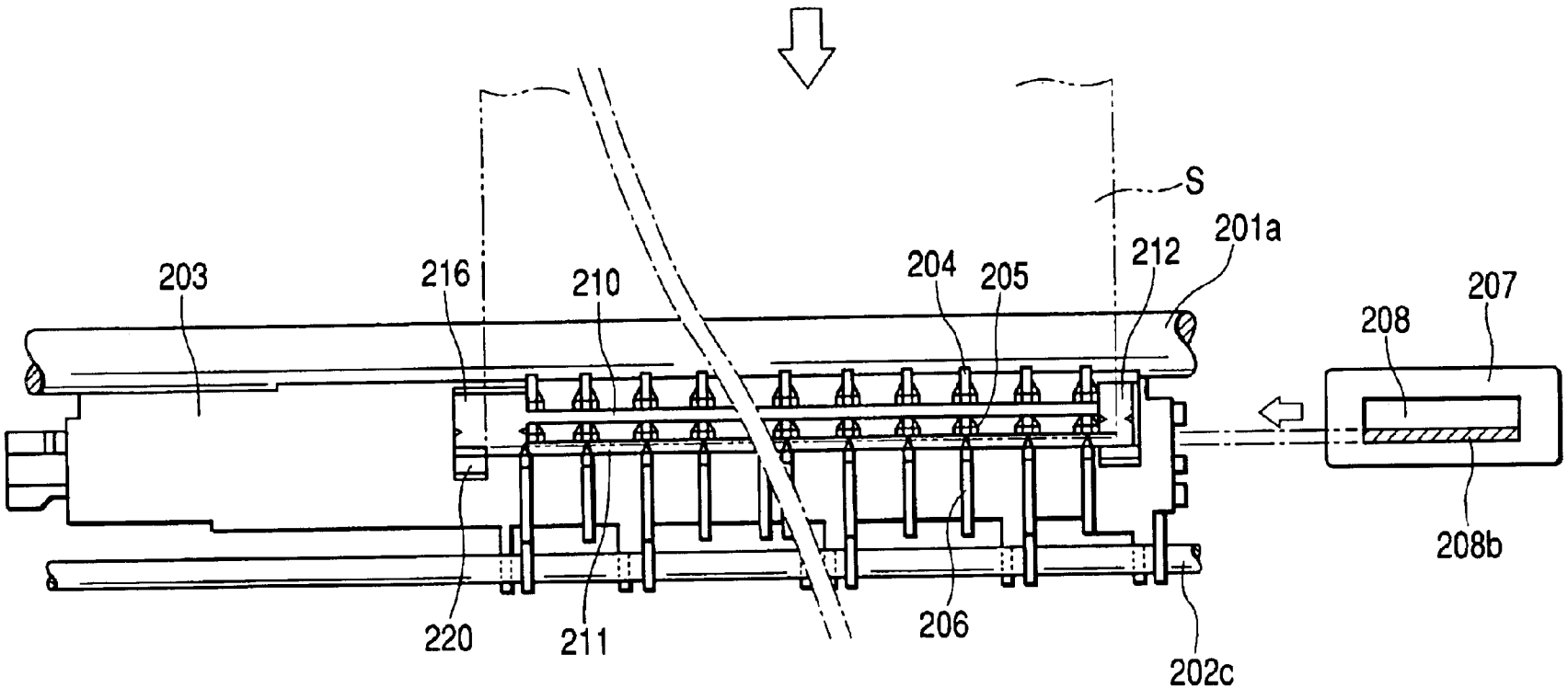
FIG. 8 is a plan view showing a recording section in the ink jet printer of FIG. 7, showing a condition that the marginless printing for a leading end of a sheet is performed.

Marginless printing to be carried out over the sheet S will be described with reference to FIGS. 8 to 11. In FIG. 8, the platen 203 is elongated in the primary scanning direction (a transverse direction in FIG. 8) and ribs 204, 205 and 206 are formed on a platen surface (the upper surface of the platen 203: an opposed surface to the recording head 207) so as to extend in the delivery direction (secondary scanning direction) and arranged at a predetermined interval in the primary scanning direction as shown in FIG. 8.

Moreover, two groove holes 210 and 211 extended in the primary scanning direction are formed on the platen surface of the platen 203 as shown in FIG. 8, and furthermore, square groove holes 212 to 216 (see FIG. 15) are formed in portions to be positioned on the side edges of the sheet S. The groove holes 210 and 211 are formed to have predetermined depths from the recording head 207 as shown in FIG. 9. Moreover, the groove holes 212 to 216 are also formed to have almost the same depths as those of the groove holes 210 and 211. While a waste liquid absorber for absorbing an ink drop is provided in the groove holes 210 to 216, it will be described below in detail.

The groove holes 210, 211 and 212 to 216 are used for disposing away ink (liquid) to print four sides of the sheet S without a margin and the ink ejected from the nozzle array 208 is disposed into the groove holes 212 to 216. For example, in the marginless printing at the leading end of the sheet 8, when the leading end of the sheet S reaches the upper part of the groove hole 211 positioned on the downstream side in the delivery direction as shown in FIGS. 8 and 9, only a part 208*b* of the nozzle array 208 is driven to eject ink drop onto the sheet S. Consequently, the ink drop deviated from the leading end of the sheet S is disposed into the groove hole 211. Accordingly, the platen surface can be prevented from being contaminated with the ink drop.

Figure 10:
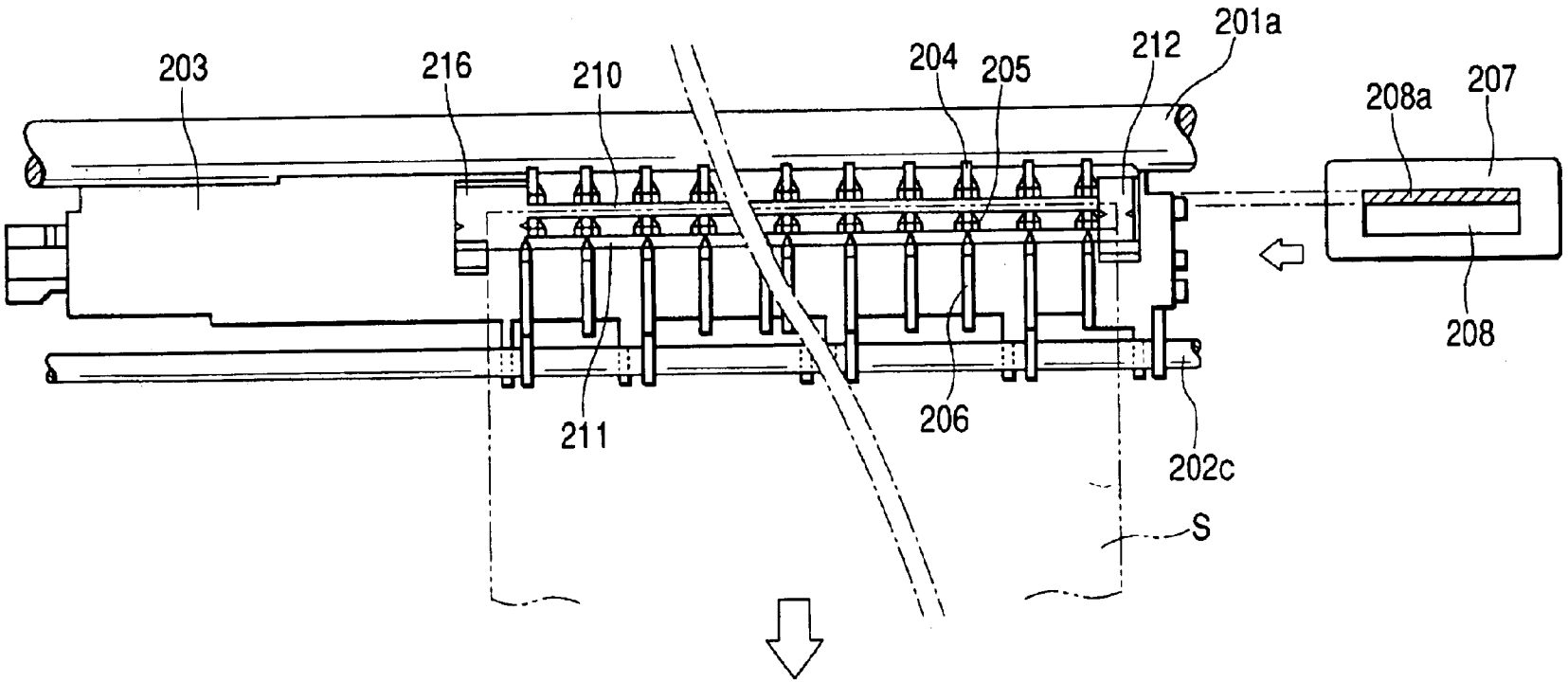
FIG. 10 is a plan view showing the recording section in the ink jet printer of FIG. 7, showing a condition that the marginless printing for a trailing end of a sheet is performed.
Figure 11:
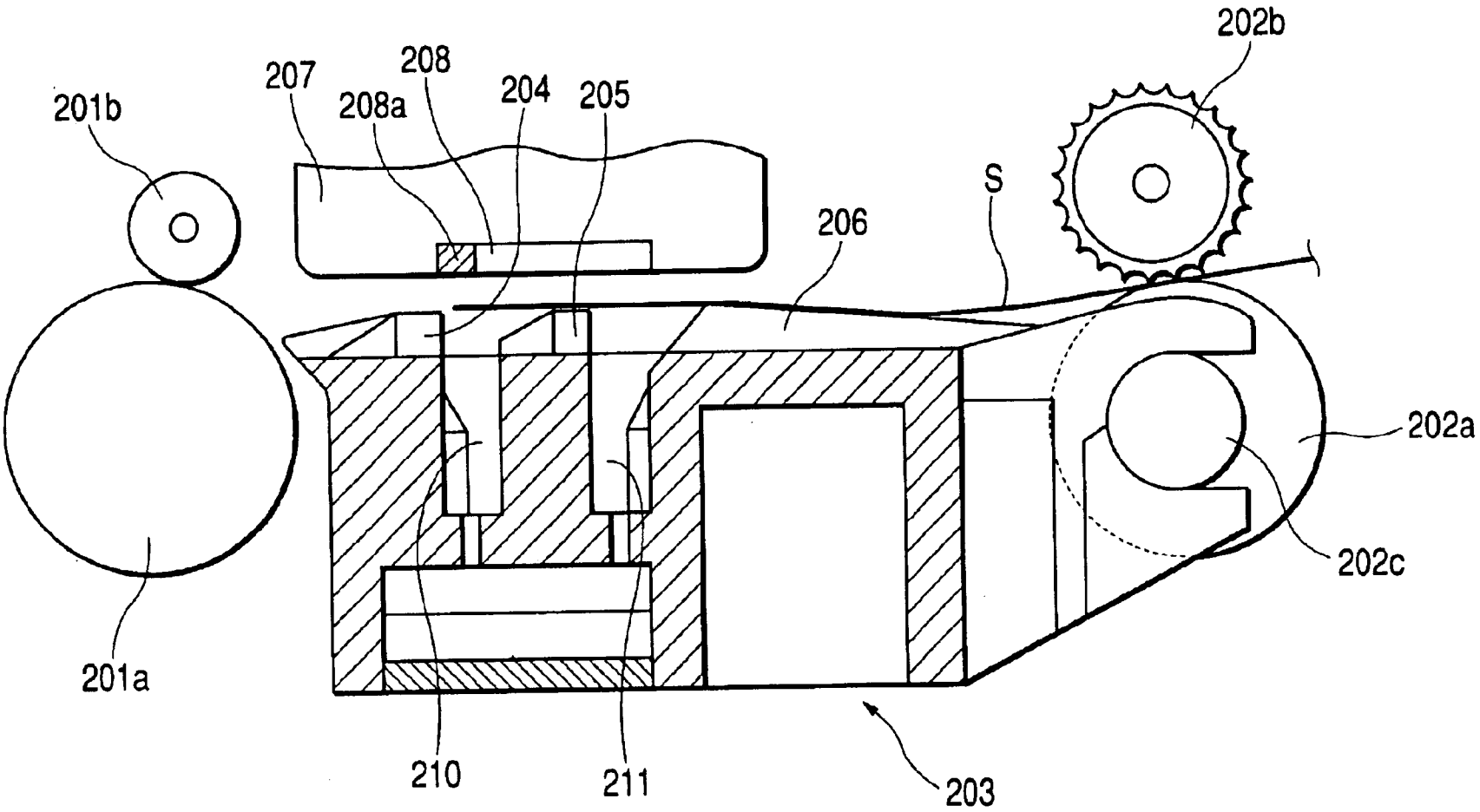
FIG. 11 is a sectional side view showing the recording section in the ink jet printer of FIG. 7, showing a condition that the marginless printing for a trailing end of a sheet is performed.

On the other hand, in the marginless printing at the trailing end of the sheet S, when the trailing end of the sheet S reaches the upper part of the groove hole 210 positioned on the upstream side in the delivery direction as shown in FIGS. 10 and 11, only the part 208*a* of the nozzle array 208 is driven to eject ink onto the sheet S. Consequently, the ink drop deviated from the trailing end of the sheet S is disposed into the groove hole 210. Accordingly, the platen surface can be prevented from being contaminated with the ink.

Figure 15:
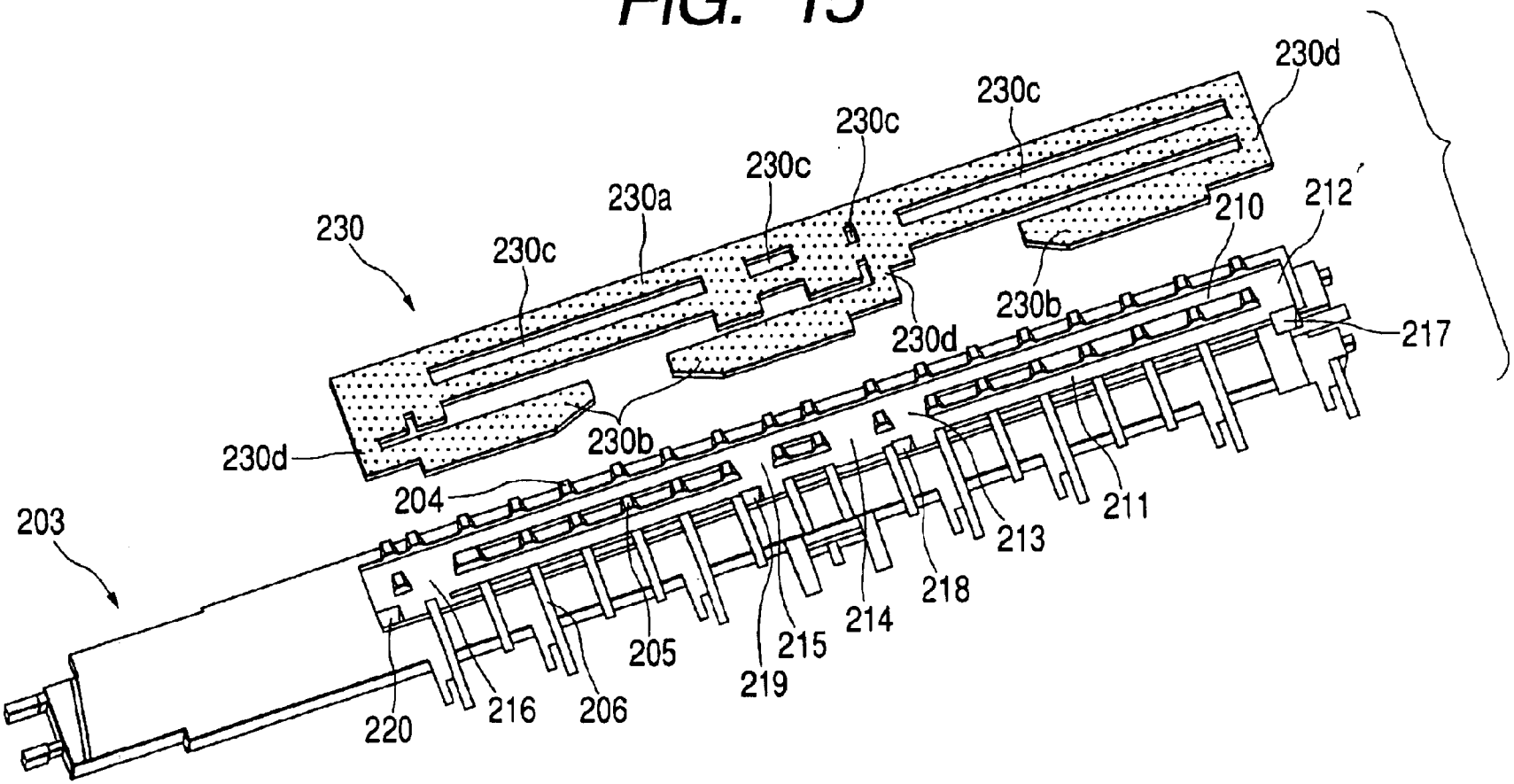
FIG. 15 is an exploded perspective view showing the appearance of a platen and a waste liquid absorber in the ink jet printer of FIG. 7.

In the marginless printing on both side ends of the sheet S, the groove holes 212 to 216 fulfill the same functions. More specifically, in the sheet S shown in a virtual line of FIGS. 8 and 10, the ink drop deviated from both side ends of the sheet S is disposed into the groove hole 212 and the groove hole 216. As shown in FIG. 15, moreover, the groove holes 212 to 216 are provided to be localized at a predetermined interval in the primary scanning direction. More specifically, the groove hole 212 is provided in a place through which one of the side ends of each of the sheets P having all sizes passes, and the groove holes 213 to 216 are provided in places through which the other side end of each of the sheets P having predetermined sizes (for example, an A4 size, a postcard size and an L-type photograph size having a width of 89 mm) passes. Accordingly, four-side marginless printing can be executed over the predetermined sheet sizes.

A sheet discharge roller including a sheet discharge driving roller 202*a* and a sheet discharge driven roller 202*b* is provided on the downstream side of the platen 203 as shown in FIG. 9. The sheet discharge driving roller 202*a* is provided on a roller shaft 202*c* to be rotated and driven by a driving motor (not shown) so as to be localized in the transverse direction of the sheet S, and the sheet discharge driven roller 202*b* is rotated in accordance with the rotation of the sheet discharge driving roller 202*b* via a contact with the sheet discharge driving roller 202*a*. The sheet S is nipped by the sheet discharge driving roller 202*a* and the sheet discharge driven roller 202*b* and the sheet discharge driving roller 202*a* is rotated so that the sheet S subjected to printing is ejected toward a discharged sheet stacker 225 (FIG. 7).

With reference to FIGS. 12 to 16, subsequently, detailed description will be given to a waste liquid treating device for treating ink drop disposed into the platen 203 by the marginless printing.

Figure 13:
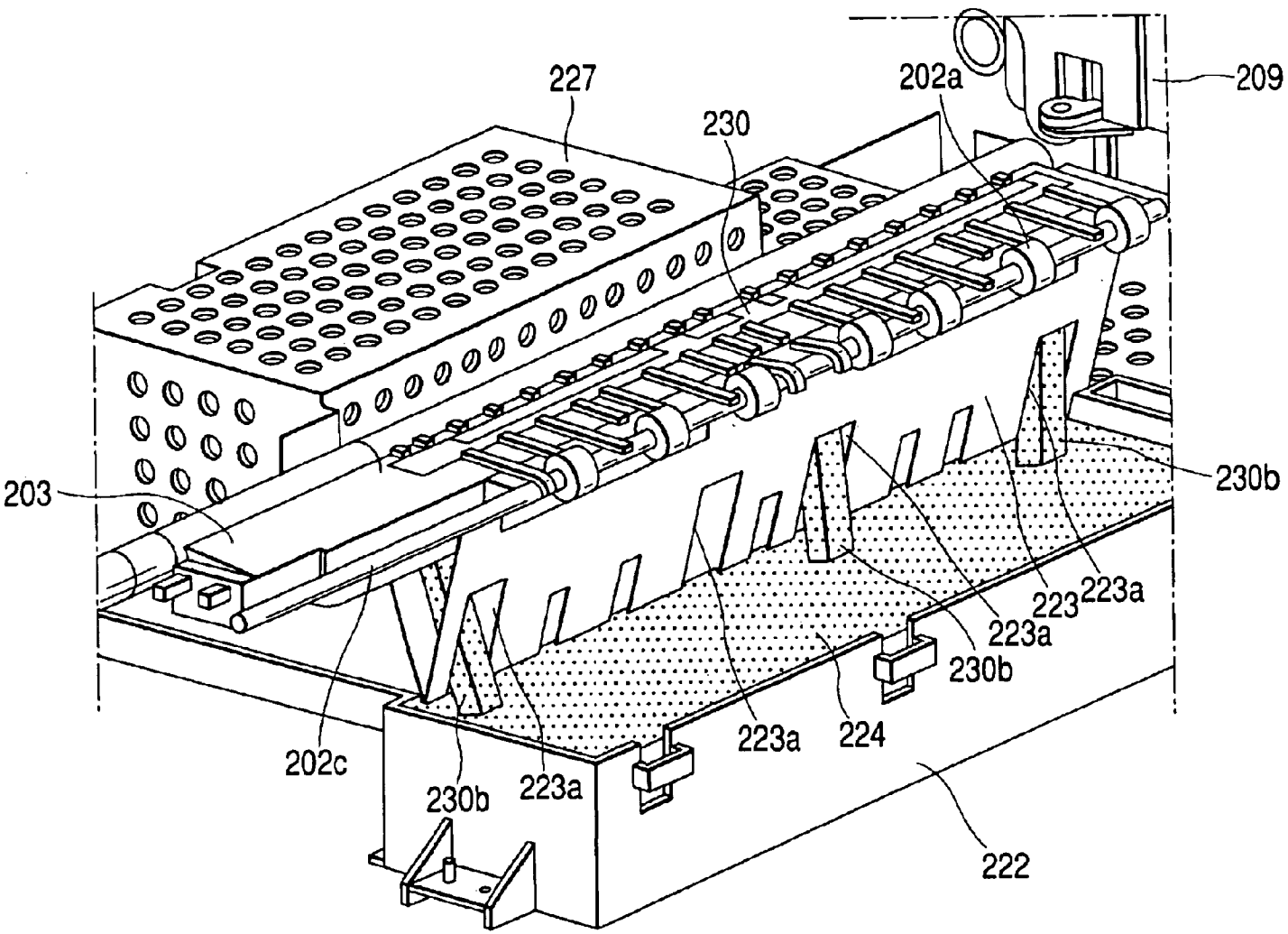
FIG. 13 is an enlarged perspective view showing the main part of the ink jet printer of FIG. 7.

The waste liquid treating device has a first waste liquid absorber shown in FIG. 15, a waste liquid tray 222 and a second waste liquid absorber 224 shown in FIG. 13, a liquid leading member 230*a*, and a guide member 223.

In FIG. 15, the first waste liquid absorber 230 is provided to be filled in the groove holes 210 to 216 formed in the platen 203 to first absorb the ink drop disposed into the groove holes 210 to 216. The first waste liquid absorber 230 may be formed by any material having a high ink absorbance and a high ink-resistance. For example, a synthetic fiber such as polyethylene terephthalate, acryl or rayon, a felt material formed of pulp or a porous material such as a sponge can be used. This is also common to the second waste liquid absorber 224 which will be described below. In the embodiment, a foaming soft material (a so-called sponge material: for example, a trade name of "Ever Light" manufactured by BRIDGESTONE CORPORATION) is used for the first waste liquid absorber 230.

The first waste liquid absorber 230 is provided with a plurality of holes 230*c* to keep away from the rib 205 formed on the platen 203. Consequently, all the groove holes 210 to 216 can be filled with a single and integrally formed first waste liquid absorber 230. Moreover, the first waste liquid absorber 230 is formed with a plurality of tongue piece sections 230*b* serving as a waste liquid leading member which will be described below.

As shown in FIG. 15, each of the tongue piece sections 230*b* is formed to be extended in the primary scanning direction through a connecting section 230*d*. The respective connecting sections 230*d* are formed at both ends of the first waste liquid absorber 230 and a portion shifted from a longitudinal center portion of the first waste liquid absorber 230 to the home position side (the right side in FIG. 15). When the first waste liquid absorber 230 is to be provided in the groove holes 210 to 216, the connecting section 230*d* is first wrenched and the tongue piece section 230*b* is thus set to be extended downward. Next, the tongue piece sections 230*b* are inserted into the through holes 217, 218 and 220 respectively continued from the groove holes 212, 213 and 216, and are thus caused to hang downward from the platen 203.

On the other hand, the waste liquid tray 222 which is elongated in the primary scanning direction and is almost-box shaped as shown in FIG. 13 is provided under the platen 203, and a second waste liquid absorber 224 is filled in the waste liquid tray 222 without a clearance While the second waste liquid absorber 224 may be formed by any material having a high ink absorbance and a high ink-resistance, a nonwoven fabric (manufactured by OJI QUINOCROSS CO., LTD., for example) is used in the embodiment. The lower end of the liquid leading member 230*b* hanging down from the platen 203 is maintained in contact with the upper surface of the second waste liquid absorber 224 provided in the waste liquid tray 222 (see FIG. 14).

The ink drop disposed into the groove holes 210 to 216 of the platen 203 is first absorbed in the first waste liquid absorber 230 provided in the groove holes 210 to 216 and proceeds to the bottom portion of the first waste liquid absorber 230, and then passes the through holes 217, 218, 219 and 220 formed in the platen 203 and is then absorbed in the second waste liquid absorber 224 provided thereunder.

In the case in which the waste liquid leading member 230*b* is not provided, for example, the ink drop does not smoothly proceed from the first waste liquid absorber 230 toward the second waste liquid absorber 224 so that the ink drop is apt to stay in the bottom portion of the first waste liquid absorber 230. More specifically, although the first waste liquid absorber 230 has a high ink absorbance, it easily holds the absorbed ink drop so that the ink drop stays in the bottom portion of the first waste liquid absorber 230.

When the printer 200 is greatly inclined in such a state by the handling of a user or in transportation, for example, the ink drop held in the bottom portion of the first waste liquid absorber 230 would be collected into the end portions of the groove holes 210 and 211, more specifically, the groove hole 212 or 216 portion shown in FIG. 15. In the worst case, there is an anxiety that the ink drop might overflow out of the platen 203. If such a phenomenon arises, there is also an anxiety that the components of the printer 200 (for example, a driving system or an electric system) might be adversely affected, and furthermore, the ink might leak out of the printer 200, resulting in the contamination of the appearance of the printer 200.

Figure 14:
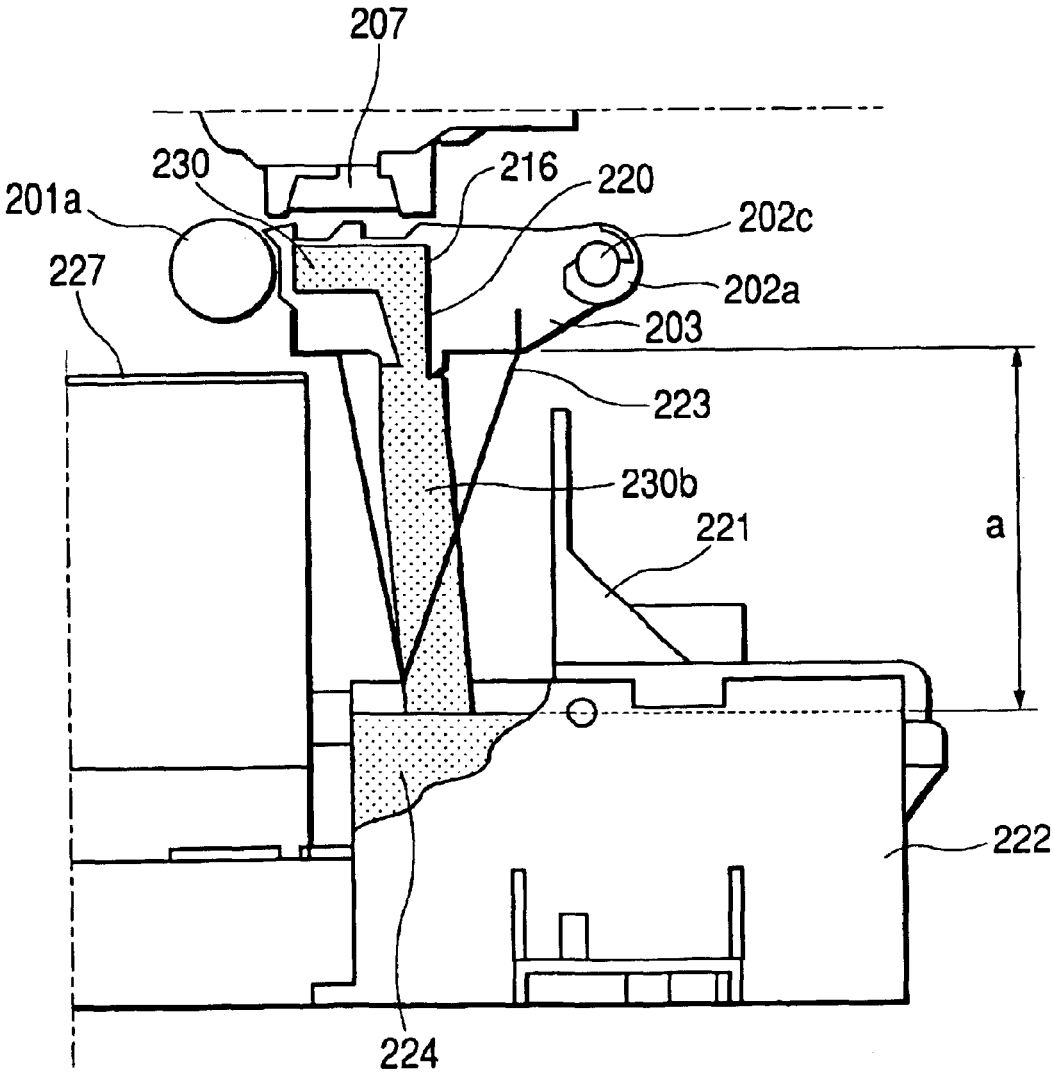
FIG. 14 is a sectional side view showing the main part of the ink jet printer of FIG. 7.

In the embodiment, therefore, the waste liquid leading member 230*b* is provided to hang downward from the through holes 217, 218 and 220 and the lower end thereof is caused to come in contact with the upper surface of the second waste liquid absorber 224 as shown in FIGS. 13 and 14. In this case, the liquid absorbance of the second waste liquid absorber 224 acts on the waste liquid leading member 230*b* and the first waste liquid absorber 230. Consequently, the ink drop does not stay in the bottom portion of the first waste liquid absorber 230 but smoothly proceeds to the second waste liquid absorber 224 side.

In other words, there is provided the waste liquid leading member 230*b* for reaching the upper surface of the second waste liquid absorber 224 from the groove holes 210 to 216 via the through holes 217, 218 and 220, thereby connecting the first waste liquid absorber 230 to the second waste liquid absorber 224 to smoothly lead the ink drop from the first waste liquid absorber 230 to the second waste liquid absorber 224. Also in the case in which the printer 200 is greatly inclined in handling or transportation, it is possible to eliminate a drawback that the ink drop staying in the bottom portion of the first waste liquid absorber 230 is collected into the end of the platen 203 and overflows to the outside. Thus, a safety can be maintained during the handling or the transportation.

In the case in which the platen 203 is provided in the printer 200 in such a manner that either the home position side or the away position side is inclined depending on precision in a component or precision in an assembly, the ink would be collected at the low position side so that the ink is apt to overflow as described above. Also in such a case, according to the embodiment, the ink drop is smoothly absorbed in the second waste liquid absorber 224 in the lower part. Consequently, the problem of the ink overflow described above can be solved more reliably.

In the embodiment, such a structure as to obtain advantages is further employed as will be described below. In the embodiment, a difference in a height (an interval "a" in FIG. 14) between the upper surface of the second waste liquid absorber 224 and the bottom portion of the platen 203 is approximately 40 to 50 mm. Accordingly, the waste liquid leading member 230*b* vertically hangs downward from the through holes 217, 218 and 220 almost straight as shown in FIG. 14. Consequently, the ink passing through the waste liquid leading member 230*b* forms a long water column so that force for leading the ink drop staying in the bottom portion of the first waste liquid absorber 230 to the second waste liquid absorber 224, that is, sucking force is increased still more. In the embodiment, accordingly, the ink can be led from the first waste liquid absorber 230 to the second waste liquid absorber 224 still more reliably.

The waste liquid leading member 230*b* is provided integrally with the first waste liquid absorber 230. As compared with the case in which the waste liquid leading member 230*b* and the first waste liquid absorber 230 are constituted separately, the waste liquid leading member 230*b* can be provided at a very low cost.

In the embodiment, the liquid absorbance of the second waste liquid absorber 224 is constituted to be higher than that of each of the first waste liquid absorber 230 and the waste liquid leading member 230*b*. Consequently, it is possible to increase such a degree (sucking force) that the second waste liquid absorber 224 draws the liquid from the first waste liquid absorber 230 and the waste liquid leading member 230*b*. Accordingly, the liquid can be led from the first waste liquid absorber 230 to the second waste liquid absorber 224 still more reliably. The "high liquid absorbance" implies that the capillary action of the second waste liquid absorber 224 is more remarkable than that of each of the first waste liquid absorber 230 and the waste liquid leading member 230*b* and the liquid is absorbed in the same amount within a wider range.

Figure 16:
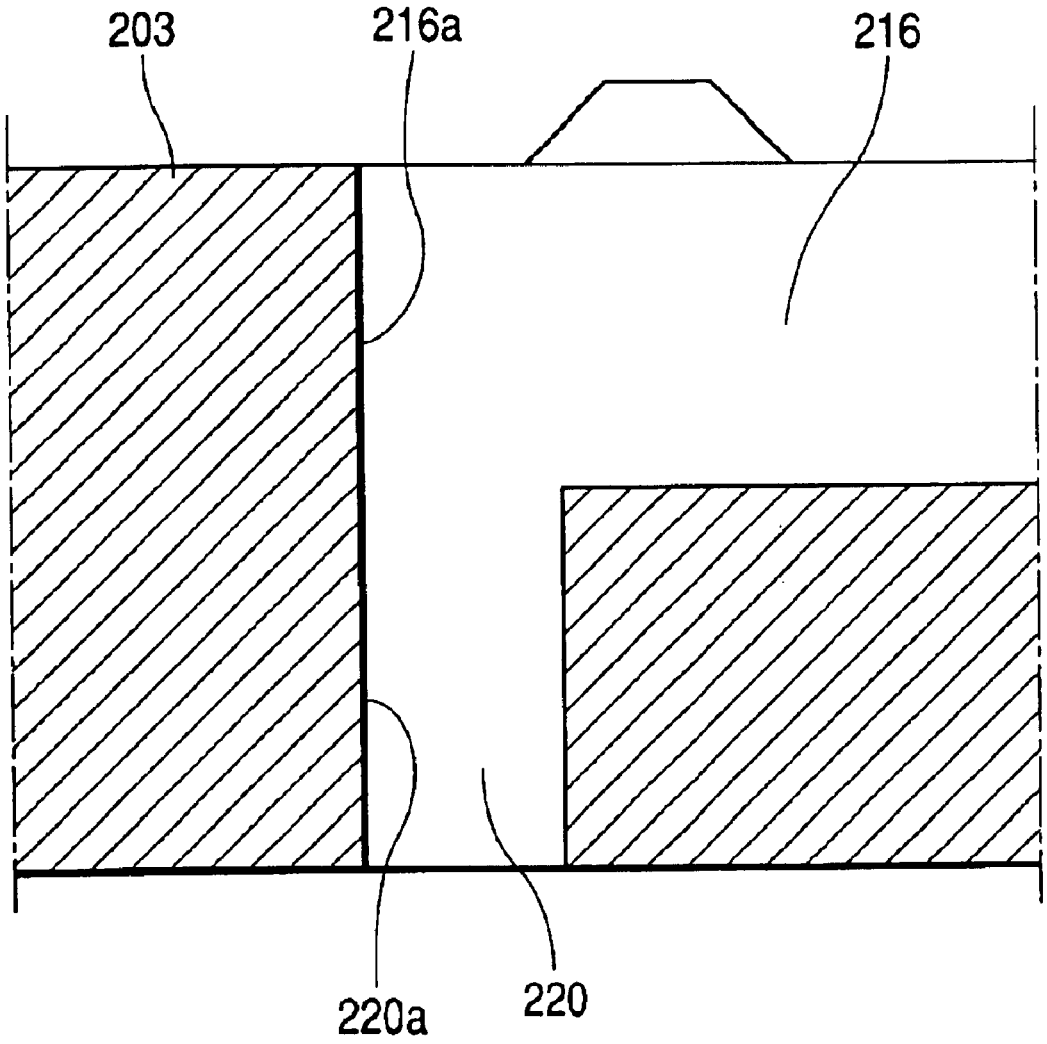
FIG. 16 is an enlarged section view showing the platen in the ink jet printer of FIG. 7.

The through holes 217 and 220 are provided on both ends of the groove holes 210 and 211 extended in the primary scanning direction and the internal wall surfaces of the through holes 217 and 220 are made flush with the side walls of both ends of the groove holes 210 and 211 (the side walls of the groove holes 212 and 210), and the waste liquid leading member 230*b* is provided to reach the upper surface of the second waste liquid absorber 224 along the side walls of both ends of the groove holes 210 and 211 (the side walls of the groove holes 212 and 216) and the internal wall surfaces of the through holes 217 and 220 linked to the side walls. FIG. 16 shows, as a typical example, the sections of the groove hole 216 and the through hole 220.

As shown in this figure, a side wall 216*a* of the groove hole 216 and a side wall 220*a* of the through hole 220 are made flush with each other. The waste liquid leading member 230*b* is provided to hang downward along the side wall 216*a* and the side wall 220*a* (which is not shown in FIG. 16). In other words, in the case in which the printer 200 is greatly inclined in such a manner that the groove hole 216 side is set into the lower side, the ink would be collected into the groove hole 216. At this time, if the side wall 220*a* of the through hole 220 is positioned in an upper part than the side wall 216*a* of the groove hole 216 (the right side in FIG. 16), for example, an ink staying portion having the side wall 216*a* to be a bottom portion is formed. Consequently, there is an anxiety that the ink might overflow from the staying portion.

In order to eliminate the ink staying portion when the printer 200 is inclined in this way, the side wall 220*a* of the through hole 220 is made flush with the side wall 216*a* of the groove hole 216, and the waste liquid leading member 230*b* is provided in the same portion. Consequently, it is possible to reliably solve the problem of the ink overflow described above. In the embodiment, furthermore, the first waste liquid absorber 230 is provided to reliably cause an end face thereof to come in contact with the side wall 216*a* of the groove hole 216 (which is not shown). Consequently, the ink is smoothly led downward in the same manner.

The platen 203 is provided with the through holes 218 and 219 in the positions slightly shifted from the longitudinal center portion toward the home position side in addition to the through holes 217 and 220 on both longitudinal ends, and the waste liquid leading member 230*b* is provided in the through hole 218. Consequently, the ink drop disposed into the groove holes 210 to 216 can be led to the second waste liquid absorber 224 (the waste liquid tray 222) still more smoothly in the case in which the printer 200 is usually installed in a horizontal state to be used as well as the case in which the printer 200 is inclined.

As shown in FIGS. 13 and 14, the guide member 223 is provided under the platen 203. The guide 223 is formed by bending a transparent and flexible sheet material to have an almost V shape seen from a side as shown in FIG. 14, and has an elongated shape in the primary scanning direction in the same manner as the platen 203. An upper end of the guide member 223 is fixed to the platen 203.

A plurality of slits 223*a* extended in a vertical direction as shown in FIG. 13 are formed on the side wall at the front side (the right side of FIG. 14) at a predetermined interval in the longitudinal direction (the primary scanning direction) of the platen 203. Each of the slits 223*a* is formed in a place which is almost coincident with the position in which the waste liquid leading member 230*b* hanging downward from the platen 203 is provided, so that the waste liquid leading member 230*b* is inserted through the slit 223*a*to reach the upper surface of the second waste liquid absorber 224 as shown in FIG. 13.

Accordingly, the attitude and position of each waste liquid leading member 230*b* hanging downward is restrained by each slit 223*a*. Consequently, the attitude and position of each waste liquid leading member 230*b* is not changed but determined uniformly without the influence of a variation in an assembly or a vibration generated by transportation.

More specifically, the lower end of the waste liquid leading member 230*b* comes in contact with the upper surface of the second waste liquid absorber 224 so that the ink is led from the first waste liquid absorber 230 to the second waste liquid absorber 224. If the lower end of the waste liquid leading member 230*b* does not come in contact with the upper surface of the second waste liquid absorber 224 due to the variation in an assembly or the vibration generated by the transportation, for example, the above described advantages cannot be obtained. However, the attitude and position of each liquid leading member 230*b* is restrained by the guide member 223 (the slits 223*a*). Consequently, the ink can be always led reliably from the first waste liquid absorber 230 to the second waste liquid absorber 224, As shown in FIGS. 13 and 14, an electronic unit 227 is provided on the rear side of the guide member 223. The electronic unit 227 is formed by a housing having an electromagnetic shielding property. When the waste liquid leading member 230*b* wetted with the ink drop comes in contact with the electronic unit 227, the ink drop might enter the electronic unit 227, resulting in a deterioration in the electrical characteristic of the electronic unit 227. However, the slits 223*a*are formed on only the wall surface at the front side of the sheet material bent to have the almost V shape and is not formed on the wall surface at the rear side (the left side of FIG. 14). Consequently, the waste liquid leading member 230*b* does not come in contact with the electronic unit 227. Thus, the electrical characteristic of the electronic unit 227 is not deteriorated.

Figure 12:
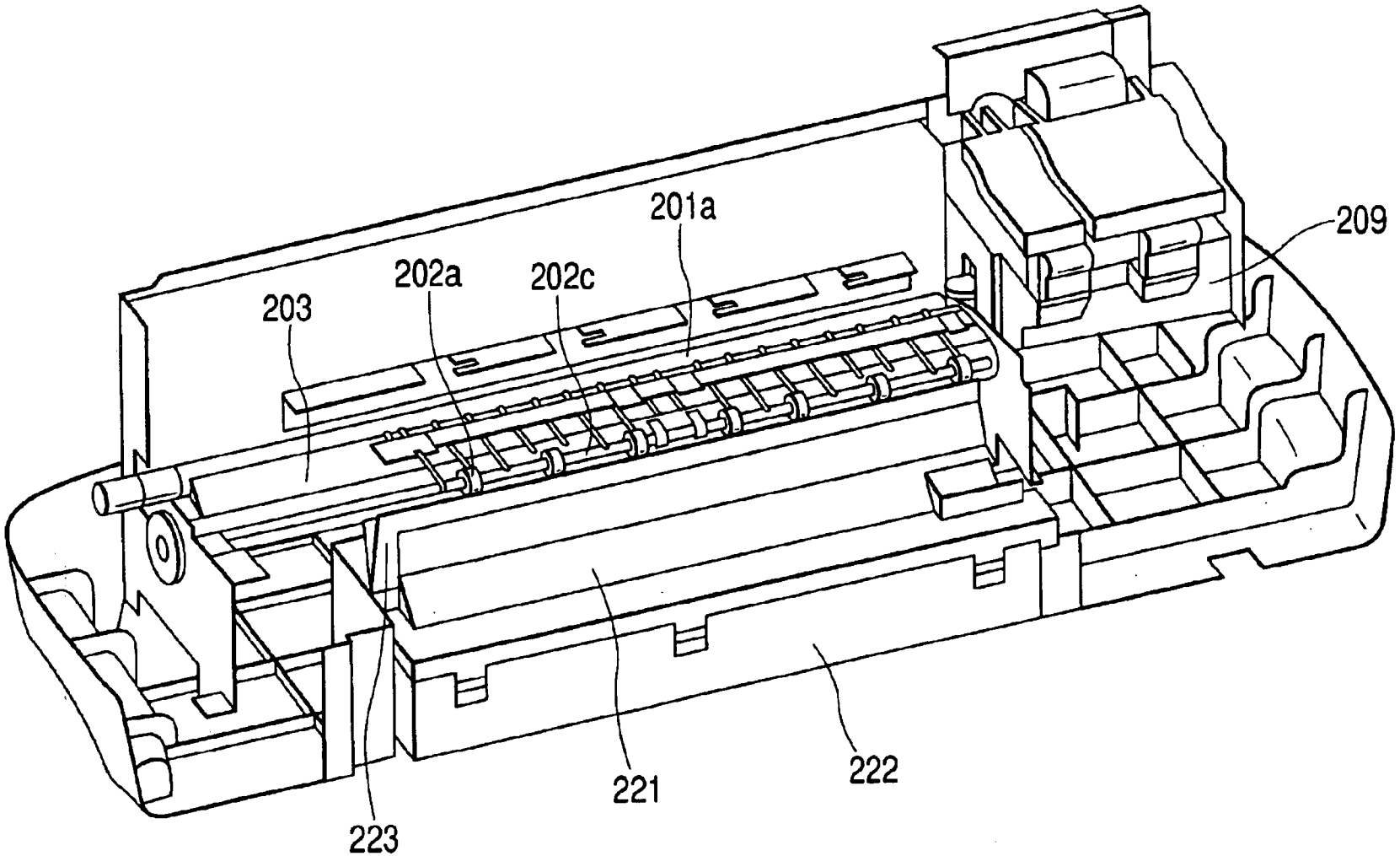
FIG. 12 is a perspective view showing the appearance of a main part of the ink jet printer of FIG. 7.

Moreover, a cover member 221 for covering the upper part of the waste liquid tray 222 is provided on the front side of the guide member 223 as shown in FIGS. 12 and 14. Therefore, the amount of forward movement of the guide member 223 is regulated so that the attitude and position of the waste liquid leading member 230*b* can be held still more reliably.

Figure 17:
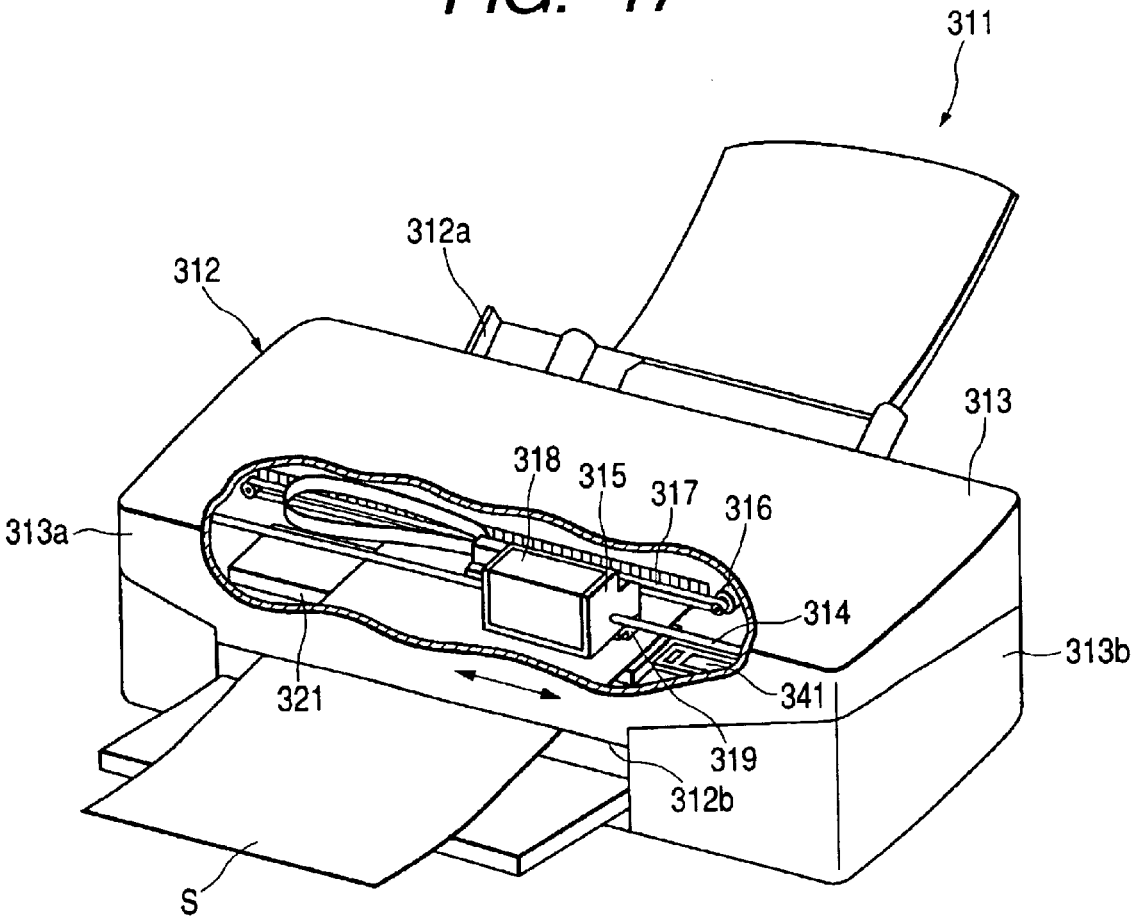
FIG. 17 is a partially broken perspective view showing the appearance of an ink jet printer according to a third embodiment of the invention.

Next, a third embodiment of the invention will be described with reference to FIGS. 17 to 20. As shown in FIG. 17, an ink jet printer 311 as a liquid ejecting apparatus comprises a printer body 312 and a feeder 312*a* provided on the rear side of the printer body 312. Sheets S stacked on the feeder 312*a* are fed into the printer body 312 one by one.

The printer body 312 includes a case 313 having the shape of an almost rectangular parallelepiped and a carriage guide shaft 314 is provided between both of left and right side plates 313*a*and 313*b* of the case 313. A carriage 315 is slidably supported on the carriage guide shaft 314. The carriage 315 is coupled to a carriage motor 316 through a timing belt 317 and is driven in a direction of an arrow in the drawing, that is, a primary scanning direction by the driving operation of the carriage motor 316.

Moreover, an ink cartridge 318 for storing ink (liquid) is removably attached to the upper side of the carriage 315, and a recording head 319 as a liquid ejecting head for receiving the supply of ink from the ink cartridge 318 is provided on the lower side of the carriage 315. The recording head 319 includes a nozzle driving member formed by a piezoelectric vibrator (which is not shown) and serves to eject an ink drop downward from a nozzle formation surface (not shown) based on the vibrating action of the nozzle driving member.

Figure 18:
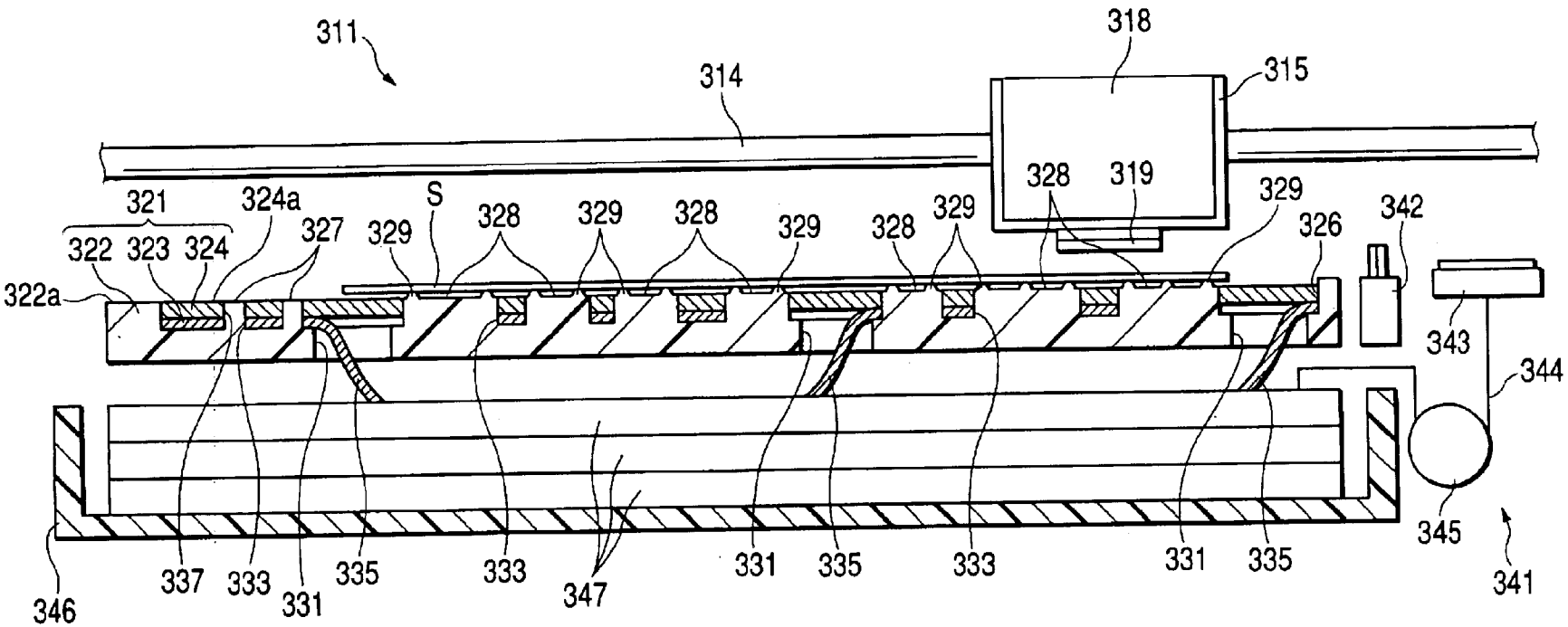
FIG. 18 is a transverse section view showing a main part of the ink jet printer of FIG. 17.

As shown in FIGS. 17 and 18, moreover, a platen 321 is provided in parallel with the carriage guide shaft 314 under a portion in which the recording head 319 is to be scanned. The sheet S fed by the feeder 312*a* is guided onto the platen 321, and is delivered by a sheet feeding member (not shown) in a secondary scanning direction which is orthogonal to the scanning direction of the carriage 315, and the ink is ejected from the recording head 319 over the platen 321 so that a character and an image are printed on the sheet S.

Figure 19:
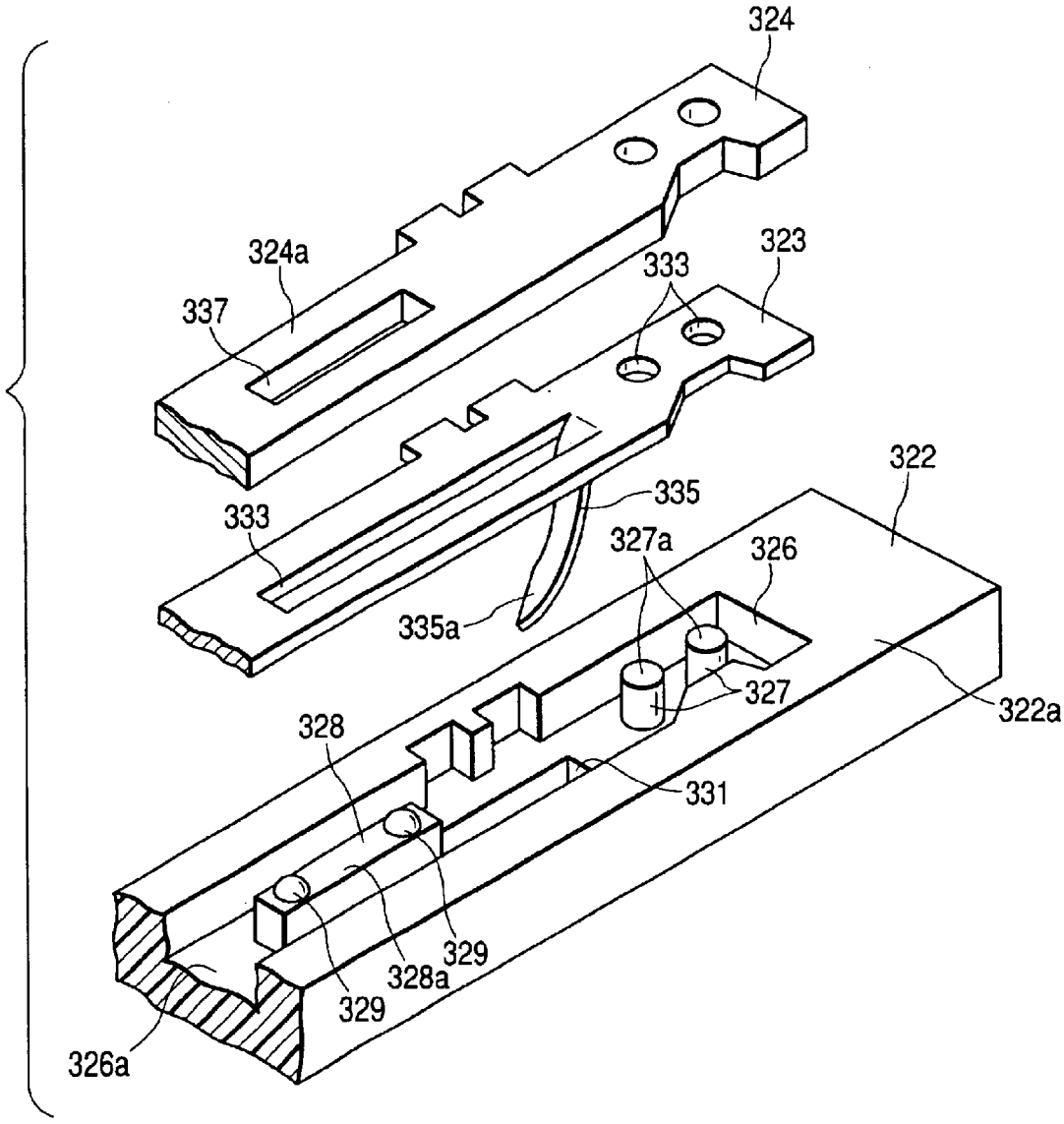
FIG. 19 is an exploded perspective view showing a platen and waste ink absorbers in the ink jet printer of FIG. 17.
Figure 20:
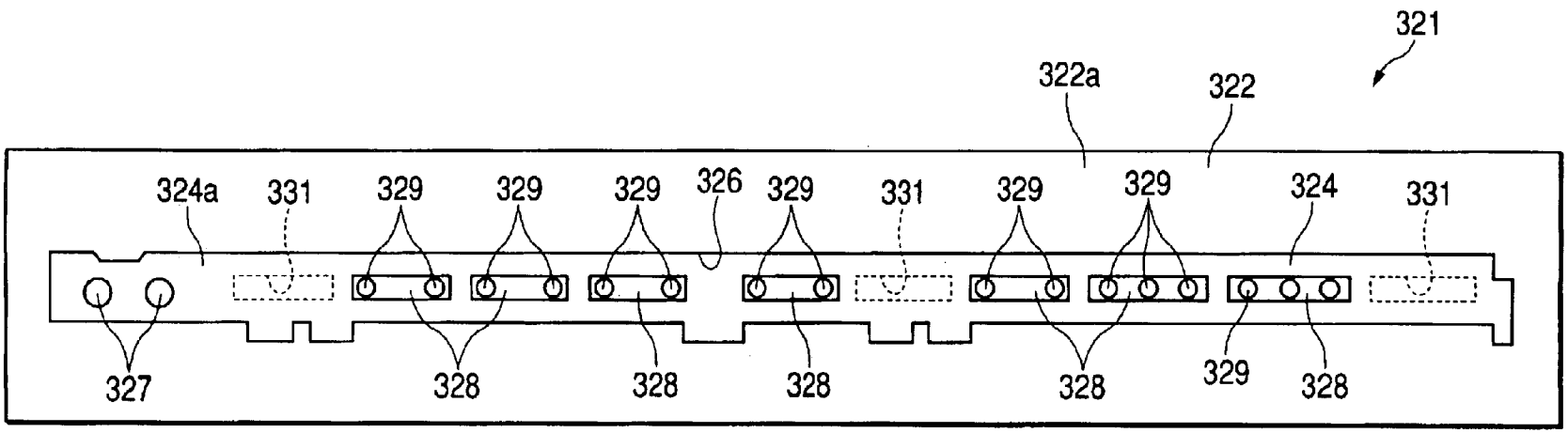
FIG. 20 is a plan view showing the platen in the ink jet printer of FIG. 17.

As shown in FIG. 18, the platen 321 is constituted by a platen base 322 to be a plate-shaped base member, a first liquid absorber 324 and a third liquid absorber 323. More specifically, as shown in FIGS. 19 and 20, the platen base 322 is formed of resin and formed with a concaved portion 326 having the shape of an almost rectangular parallelepiped on an upper surface 322*a*. The concave portion 326 is provided in such a size as to include the movable range of the recording head 319 in the primary scanning direction.

A plurality of cylindrical convex portions 327 and a plurality of rectangular parallelepiped-shaped convex portions 328 are protruded upward from a bottom surface 326*a* of the concave portion 326. An upper surface 327*a* of the cylindrical convex portion 327 and an upper surface 328*a* of the rectangular parallelepiped-shaped convex portion 328 have a height which is coincident with the upper surface 322*a* of the platen base 322 Moreover, two or three hemispherical portions 329 are provided on the upper surface 328*a* of each of the rectangular parallelepiped-shaped convex portions 328. In the platen base 322, accordingly, the upper end of the hemispherical portion 329 is placed in the highest position.

Furthermore, the platen base 322 includes a through hole 331 having an almost rectangular section to penetrate through the bottom surface 326*a* of the concave portion 326. Three through holes 331 are arranged in the primary scanning direction as shown in FIG. 18.

The printer 311 according to this embodiment can carry out marginless printing. In FIG. 18, the through hole 331 formed on the rightmost side is provided in such a position as to receive an excessive ink deviated from the right edge of the sheet S when the marginless printing is executed. Moreover, two other through holes are provided in such positions as to receive an excessive ink deviated from the left edge of the sheet S when the sheet S having a rated size, for example, an A4 size or a postcard size is guide onto the platen 321. The sheet S shown in FIG. 18 has the A4 size and the margin of the sheet S overlaps with the through hole 331 on the leftmost side. The structure of the platen base 322 has conventionally been used.

The third liquid absorber 323 is formed by a porous material having a great sucking force and has an outer shape in a plane direction which is almost coincident with the concave portion 326 of the platen base 322. Moreover, a thickness is approximately a quarter of the whole depth of the concave portion 326 of the platen base 322. As shown in FIG. 20, the third liquid absorber 323 has an opening portion 333 in such positions as to overlap with the cylindrical convex portion 327 and the rectangular parallelepiped convex portion 328 of the platen base 322. The above structure has conventionally been employed.

In addition to the conventional structure, moreover, the third liquid absorber 323 is newly provided with a plurality of tongue piece sections (waste liquid leading members) 335 in such positions as to overlap with three through holes 331 provided in the platen base 322. Each of the tongue piece sections 335 is formed by providing an U-shaped slit in the third liquid absorber 323 and then bending a portion inside the slit downward.

Moreover, a tip 335*a* of each tongue piece section 335 is cut obliquely with respect to the scanning direction of the carriage 315.

The third liquid absorber 323 is fitted in the concave portion 326 with the convex portions 327 and 328 penetrating through the opening portions 333. Moreover, the third liquid absorber 323 causes each tongue piece section 335 to hang downward via each of the through holes 331 of the platen base 322 in a fitting state in the concave portion 326 (see FIG. 18).

The first liquid absorber 324 is formed by a porous material having a lower density than the third liquid absorber 323 and has an outer shape in a plane direction which is almost coincident with the concave portion 326 of the platen base 322. Moreover, a thickness is approximately three quarters of the whole depth of the concave portion 326 of the platen base 322. The first liquid absorber 324 has an opening portion 337 in such positions as to overlap with the cylindrical convex portion 327 and the rectangular parallelepiped-shaped convex portion 328 of the platen base 322. The first liquid absorber 324 is fitted in the concave portion 326 to be superposed on the third liquid absorber 323 in such a state that the convex portions 327 and 328 penetrate through the opening portions 337.

Accordingly, the platen 321 is constituted by sequentially fitting the third liquid absorber 323 and the first liquid absorber 324 in the concave portion 326 of the platen base 322. In this case, as shown in FIG. 18, the upper surface 322*a* of the platen base 322 is positioned on almost the same level with an upper surface 324*a* of the first liquid absorber 324. As a result, only the hemispherical portion 329 formed on the rectangular parallelepiped-shaped convex portion 328 of the platen base 322 is protruded from the upper surface of the platen 321, and the sheet S guided onto the platen 321 is supported by the hemispherical portion 329 to form a predetermined sheet gap with the recording head 319.

As shown in FIG. 17, moreover, the printer 311 comprises a capping member 341 in a non-print region (a home position). The capping member 341 includes a wiping member 342, a cap 343, a sucking tube 344 connected to the cap 343, and a sucking pump 345 provided in the middle of the sucking tube 344 as shown in FIG. 18.

The wiping member 342 is provided on the print region side of the cap 343 and is constituted to sweep and clean the nozzle formation surface of the recording head 319 if necessary. The cap 343 is constituted to seal the nozzle formation surface of the recording head 319 of the carriage 315 moved to the home position, and serves as a cover member for preventing the nozzle formation surface of the recording head 319 from being dried for the deactivated period of the printer 311.

Moreover, the sucking pump 345 can apply a negative pressure into the cap 343 sealing the nozzle formation surface through the sucking tube 344, so that ink is sucked out from nozzle orifices, thereby carrying out cleaning for recovering the ink ejecting capability of the recording head 319.

Furthermore, the printer 311 comprises a waste liquid tank 346 having an upper side opened at a lower bottom part in the case 313. A plurality of second waste liquid absorber 347 formed by a porous material are stacked in the waste liquid tank 346. The end of the sucking tube 344 of the capping member 341 is positioned in the waste liquid tank 346 and the ink generated during the cleaning is fed into the waste liquid tank 346 and is absorbed and held in the second waste liquid absorber 347. The waste liquid tank 346 and the second waste liquid absorber 347 are positioned just below the platen 321, and furthermore, has such a size as to include a whole region in the longitudinal direction of the platen 321.

A distance between the platen 321 and the waste liquid tank 346 is set in such a manner that each tongue piece section 335 of the third liquid absorber 323 comes in contact with the upper surface of the second waste liquid absorber 347. Moreover, the second waste liquid absorber 347 has a higher absorbance than the third liquid absorber 323 so that the liquid absorbed in the third liquid absorber 323 is easily moved to the second waste liquid absorber 347 through the tongue piece sections 335.

By the above structure, accordingly, in the case in which marginless printing for setting vertical and transverse margins to be zero is carried out in the printer 311, an ink drop ejected to a position deviated from the edge of the sheet S is caused to fly toward the first liquid absorber 324 of the platen 321. The ink drop is captured and absorbed by the first liquid absorber 324 and is then moved toward the third liquid absorber 323 provided on the lower side which has a higher absorbance.

The first liquid absorber 324 is formed by a porous material having a relatively lower density. Therefore, the ink is moved quickly to the third liquid absorber 323 so that the generation of an ink mist can be suppressed as greatly as possible in the vicinity of the surface of the first liquid absorber 324.

The ink moved to the third liquid absorber 323 is moved to the second waste liquid absorber 347 through the tongue piece sections 335 of the third liquid absorber 323. Each tongue piece section 335 is provided in a position overlapping with the through hole 331 of the platen base 322, that is, a position in which the ink deviated from the edge on the right side and the edge on the left side in the sheet S is concentrated in the platen 321. Accordingly, the ink is easily collected into the tongue piece sections 335 and is thus moved easily to the second waste liquid absorber 347. Then, the ink is held in the second waste liquid absorber 347 having a high water-holding property and hardly flows to the outside even if the printer 311 is inclined by mistake due to transportation between users.

In the embodiment, the through holes 331 are provided on the platen base 322 of the platen 321 to insert the tongue piece sections 335 and to cause the tongue piece sections 335 to come in contact with the second waste liquid absorber 347.

Accordingly, the ink disposed from the recording head 319 beyond the sheet S is absorbed in the tongue piece sections 335 and is absorbed in the second waste liquid absorber 347 via the through hole 331. As a result, the ink is quickly moved to the second waste liquid absorber 347 through the tongue piece sections 335 so that a time taken for a stay on the platen 321 is shortened. In the case in which the tongue piece sections 335 are not provided, the ink stays on the platen 321 until the absorption limits of the first absorber and the second absorber are reached. In the embodiment, however, the ink is moved to the second waste liquid absorber 347 before the absorption limit is reached. As a result even if the printer 311 is inclined due to the transportation between users, the ink can be prevented from leaking out of the platen 321.

In the embodiment, the tongue piece sections 335 and the second waste liquid absorber 347 are provided separately and the waste liquid absorber which has conventionally been used can be exactly used. Therefore, it is not necessary to considerably change the design of the printer 311.

In the embodiment, the tongue piece sections 335 are formed by cutting and bending the third waste liquid absorber 323 in a position of the platen base 322 overlapping with the through hole 331.

Accordingly, it is possible to easily form the tongue piece sections 335 by slightly processing the third liquid absorber 323 which has conventionally been used. Therefore, it is not necessary to considerably change the design of the printer 311.

In the embodiment, the third liquid absorber 323 and the first liquid absorber 324 have such sizes as to induce the moving range of the recording head 319. When the size of the sheet S is included in the moving range of the recording head 319, accordingly, the disposed ink can be reliably absorbed in each of the liquid absorbers 323 and 324 even if the ejected ink is deviated from all the edges of the sheet S, that is, so-called overall marginless printing is carried out.

In the embodiment, the third liquid absorber 323 and the first liquid absorber 324 are fitted in the concave portion 326 of the platen base 322. In a state in which each of the liquid absorbers 323 and 324 is fitted, the hemispherical portion 329 of the platen base 322 is placed in the highest position. When the sheet S is supported on the platen 321, accordingly, a gap can be formed by the hemispherical portion 329 between the sheet S and the first liquid absorber 324 so that they can be prevented from coming in contact with each other. As a result, the sheet S can be prevented from being contaminated with the ink absorbed in each of the liquid absorbers 323 and 324.

In the embodiment, the tip 335*a* of each tongue piece section 335 is cut obliquely with respect to the scanning direction of the carriage 315. Accordingly, the capillary action can easily be generated between each tongue piece section 335 and the second waste liquid absorber 347 so that the ink absorbed in the tongue piece sections 335 can easily be moved to the second waste liquid absorber 347.

In the embodiment, the second waste liquid absorber 347 has a higher absorbance than the third liquid absorber 323, Accordingly, the ink absorbed in the tongue piece sections 335 can easily be absorbed in the second waste liquid absorber 347. As a result, even if the printer 311 is inclined due to the transportation between users, the ink can be prevented from leaking out of the printer 311. Consequently, the time in which the liquid stays in each of the liquid absorbers 323 and 324 is shortened so that the ink can be prevented from being dried and solidified in each of the liquid absorbers 323 and 324.

In the embodiment, the platen 321 is provided with two kinds of waste liquid absorbers, that is, the third liquid absorber 323 and the first liquid absorber 324. Accordingly, a mist generated by the ink disposed into the platen 321 can easily be absorbed by the first liquid absorber 324 formed by a material having a relatively lower density. As a result, the generation of the mist can be decreased. Moreover, the ink can easily be moved by the capillary action from the first liquid absorber 324 having the relatively lower density to the third liquid absorber 323 formed by a material having a relatively higher density. As a result, the ink can be quickly moved to the tongue piece sections 335 of the third liquid absorber 323. Thus, the ink can be moved to the second waste liquid absorber 347 more reliably.

In the embodiment, the through holes 331 formed on the platen base 322 are provided in the positions overlapping with the edges on the left and right sides of the sheet S having a rated size.

Accordingly, the through holes 331 and the tongue piece sections 335 are provided in a place in which the ink can easily be disposed, that is, a place in which the disposed ink tends to be concentrated. Thus, the ink can efficiently be moved toward the second waste liquid absorber 347 side.

The embodiment may be modified in the following manner.

While each tongue piece section 335 is formed by providing a U-shaped slit in the third liquid absorber 323 and bending a portion inside the slit downward in the embodiment, it may be formed to have another shape. Moreover, each tongue piece section 335 is not integrated with the third liquid absorber 323 but may be provided separately therefrom and may be thus attached to the third liquid absorber 323 by connecting means such as an adhesive.

Furthermore, each tongue piece section 335 is not formed by cutting out the third liquid absorber 323 but may be formed by molding simultaneously with the molding of the third liquid absorber 323.

In the embodiment, each of the liquid absorbers 323 and 324 has such a size as to include the moving range of the recording head 319. They may be provided partially.

While the tip 335*a* of the tongue piece section 335 is cut out acutely in the embodiment, it does not need to be cut out.

Although the second waste liquid absorber 347 has a higher absorbance than the third liquid absorber 323 including the tongue piece section 335 in the embodiment, it may have an equal or lower absorbance.

While the third liquid absorber 323 and the first liquid absorber 324 having different densities are provided as the liquid absorbers in the embodiment, at least three kinds of waste liquid absorbers may be used. Moreover, only one kind of waste liquid absorber may be used.

In the embodiment, the through hole 331 of the platen base 322 and the tongue piece sections 335 are provided in the positions overlapping with the edges on the left and right sides of the sheet S having a rated size. They may be provided in non-overlapping positions. While the number is set to be three, moreover, another number may be employed.

While the printer for ejecting ink (the printing apparatus including a facsimile and a copier) has been described as the liquid ejecting apparatus in the above embodiments, a liquid ejecting apparatus for ejecting another liquid may be employed. For example, it is also possible to employ a liquid ejecting apparatus for ejecting a liquid such as an electrode material or a colorant which is used for manufacturing a liquid crystal display, an EL display or an FED (a field emission display), a liquid ejecting apparatus for ejecting a biological organic matter to be used for manufacturing a biochip or a sample ejecting apparatus to be a precision pipette.

What is claimed is:

1. A liquid ejecting apparatus, comprising:

a liquid ejecting head, operable to move in a first direction;

a platen, opposed to the liquid ejecting head to support an object to which a liquid droplet is ejected from the liquid ejecting head and to define a gap between the liquid ejecting head and the object, the platen formed with a groove hole to which a liquid droplet deviated from an edge of the object is disposed, and through holes formed in a bottom portion of the groove hole and arranged in the first direction;

a tray member, arranged below the platen to receive liquid dropped through the through holes;

a first liquid absorber, provided in the groove hole;

a second liquid absorber, provided in the tray member; and at least one liquid leading member, extending through at least one of the through holes to lead liquid absorbed by the first liquid absorber to the second liquid absorber.

2. The liquid ejecting apparatus as set forth in claim 1, wherein the liquid leading member is a third liquid absorber having a liquid absorbance higher than a liquid absorbance of the first liquid absorber.

3. The liquid ejecting apparatus as set forth in claim 2, wherein a liquid absorbance of the second liquid absorber is higher than the liquid absorbance of the third liquid absorber.

4. The liquid ejecting apparatus as set forth in claim 1, wherein the through hole in which the liquid leading member is provided is placed at a position where a flushing operation of the liquid ejecting head is performed.

5. The liquid ejecting apparatus as set forth in claim 4, wherein the position at which the flushing operation is performed is not located at a home position of the liquid ejecting head.

6. The liquid ejecting apparatus as set forth in claim 1, wherein the through hole in which the liquid leading member is provided is placed at a position where a lower position of the platen which is an inclined state in connection with the first direction.

7. The liquid ejecting apparatus as set forth in claim 1, wherein the liquid ejecting apparatus is an ink jet recording apparatus in which an ink droplet is ejected toward a recording medium supported by the platen.

8. The liquid ejecting apparatus as set forth in claim 1, wherein the liquid leading member is an individual member comprised of a porous material.

9. The liquid ejecting apparatus as set forth in claim 1, wherein the liquid leading member is a sheet-like member having a portion to be extended through the at least one of the through holes.

10. The liquid ejecting apparatus as set forth in claim 9, wherein the liquid leading member has a size which is at least equal to a movable range of the liquid ejecting head in the first direction.

11. The liquid ejecting apparatus as set forth in claim 9, wherein the liquid leading member is fitted into the groove hole, and the first liquid absorber is laminated thereon.

12. The liquid ejecting apparatus as set forth in claim 1, wherein a tip end of the liquid leading member which is to be brought into contact with the second liquid absorber is cut out obliquely.

13. The liquid ejecting apparatus as set forth in claim 1, wherein a liquid absorbance of the liquid leading member is different from a liquid absorbance of the second liquid absorber.

14. The liquid ejecting apparatus as set forth in claim 1, wherein the first liquid absorber is comprised of a material having a first density, and the liquid leading member is comprised of a material having a second density.

15. The liquid ejecting apparatus as set forth in claim 1, wherein the platen is operable to support a plurality of objects having different sizes, and the through holes are located so as to correspond to edges of the objects.

16. A waste liquid treating device, comprising:

a platen, opposed to a liquid ejecting head of a liquid ejecting apparatus, to support an object to which a liquid droplet is ejected from the liquid ejecting head, the platen formed with a groove hole to which a liquid droplet deviated from an edge of the object is disposed, and a through hole formed in a bottom portion of the groove hole;

a tray member, arranged below the platen to receive liquid dropped through the through hole;

a first liquid absorber, provided in the groove hole;

a second liquid absorber, provided in the tray member;

a liquid leading member, extending through the through hole to lead liquid absorbed by the first liquid absorber to the second liquid absorber; and a guide member, which regulates an attitude and a position of the liquid leading member.

17. The waste liquid treating device as set forth in claim 16, wherein the guide member is a sheet member formed with a slit through which the liquid leading member extends.

18. The waste liquid treating device as set forth in claim 17, wherein the sheet member is comprised of an elastic resin material.

19. The waste liquid treating device as set forth in claim 17, wherein a portion of the sheet member in which no slit is formed is opposed to an electronic unit of the liquid ejecting apparatus.

20. The waste liquid treating device as set forth in claim 16, further comprising a cover member, which covers an upper portion of the tray member while retaining the guide member.

21. The waste liquid treating device as set forth in claim 16, wherein the liquid leading member is integrally formed with the first liquid absorber.

22. A waste liquid treating device, comprising:

a platen, opposed to a liquid ejecting head of a liquid ejecting apparatus, to support an object to which a liquid droplet is ejected from the liquid ejecting head, the platen formed with a groove hole to which a liquid droplet deviated from an edge of the object is disposed, and a through hole formed in a bottom portion of the groove hole;

a tray member, arranged below the platen to receive liquid dropped through the through hole;

a first liquid absorber, provided in the groove hole;

a second liquid absorber, provided in the tray member; and a liquid leading member, extending through the through hole to lead liquid absorbed by the first liquid absorber to the second liquid absorber, the liquid leading member integrally formed with the first liquid absorber.

23. The waste liquid treating device as set forth in claim 22, wherein the first liquid absorber and the liquid leading member are comprised of a porous soft material.

24. The waste liquid treating device as set forth in claim 22, wherein the second liquid absorber has a liquid absorbance higher than a liquid absorbance of the first liquid absorber and the liquid leading member.

25. The waste liquid treating device as set forth in claim 22, wherein:

a first part of an inner face of the groove hole and a second part of an inner face of the through hole are made flush with each other; and the liquid leading member extends along the first part and the second part.

26. The waste liquid treating device as set forth in claim 25, wherein:

at least one more through hole is arranged with the through hole in a direction along which the liquid ejecting head is operable to move; and the liquid leading member is provided in each of the through holes.

27. The waste liquid treating device as set forth in claim 22, wherein the liquid leading member is deformably connected to the first liquid absorber.

28. A liquid ejecting apparatus, comprising the waste liquid treating device as set forth in claim 16 or 22, wherein the platen is arranged so as to define a gap between the liquid ejecting head and the object.

* * * * *